US009488925B2

(12) United States Patent
Chiba et al.

(10) Patent No.: US 9,488,925 B2
(45) Date of Patent: Nov. 8, 2016

(54) MAGENTA TONER, DEVELOPER, AND IMAGE FORMING APPARATUS

(71) Applicants: Ryuta Chiba, Kanagawa (JP); Shinya Nakayama, Shizuoka (JP); Tsuyoshi Sugimoto, Shizuoka (JP); Hiroshi Yamada, Shizuoka (JP); Susumu Chiba, Shizuoka (JP); Shinsuke Nagai, Shizuoka (JP); Hiroshi Yamashita, Shizuoka (JP); Masana Shiba, Shizuoka (JP)

(72) Inventors: Ryuta Chiba, Kanagawa (JP); Shinya Nakayama, Shizuoka (JP); Tsuyoshi Sugimoto, Shizuoka (JP); Hiroshi Yamada, Shizuoka (JP); Susumu Chiba, Shizuoka (JP); Shinsuke Nagai, Shizuoka (JP); Hiroshi Yamashita, Shizuoka (JP); Masana Shiba, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/630,783

(22) Filed: Feb. 25, 2015

(65) Prior Publication Data

US 2015/0253687 A1 Sep. 10, 2015

(30) Foreign Application Priority Data

Mar. 4, 2014 (JP) ..... 2014-041532

(51) Int. Cl.

| | |
|---|---|
| ***G03G 9/08*** | (2006.01) |
| ***G03G 9/087*** | (2006.01) |
| ***G03G 9/09*** | (2006.01) |

(52) U.S. Cl.

CPC ..... *G03G 9/08755* (2013.01); *G03G 9/08795* (2013.01); *G03G 9/08797* (2013.01); *G03G 9/092* (2013.01)

(58) Field of Classification Search

CPC ..... G03G 9/08755; G03G 9/08795; G03G 9/08797; G03G 9/092

USPC ..... 430/109.4

See application file for complete search history.

(56) References Cited

U.S. PATENT DOCUMENTS 4,620,987 A 11/1986 Yamashita et al.
4,885,350 A 12/1989 Yamashita et al.

(Continued)

FOREIGN PATENT DOCUMENTS

JP 63-282752 A 11/1988
JP 06-250439 A 9/1994

(Continued)

OTHER PUBLICATIONS

U.S. Appl. No. 14/282,110, filed May 20, 2014.

(Continued)

*Primary Examiner* — Mark A Chapman

(74) *Attorney, Agent, or Firm* — Oblon, McClelland, Maier & Neustadt, L.L.P.

(57) ABSTRACT

A magenta toner for electrophotography, including:

a polyester resin; and a colorant containing a naphthol-based pigment, wherein the magenta toner for electrophotography satisfies requirements <1> and <2> below:

<1> [G'(100)(THF insoluble matter)] is $1.0\times10^5$ Pa to $1.0\times10^7$ Pa, and a ratio of [G'(40)(THF insoluble matter)] to the [G'(100)(THF insoluble matter)] is $3.5\times10$ or less, where the [G'(100)(THF insoluble matter)] is a storage modulus at 100° C. of THF insoluble matter of the toner and the [G'(40)(THF insoluble matter)] is a storage modulus at 40° C. of the THF insoluble matter of the toner; and <2> an X-ray diffraction pattern of the naphthol-based pigment in a crystalline state has a plurality of peaks in a range of $0°\leq2\theta\leq35°$, and a sum of half value widths of the peaks is 5° to 10°.

9 Claims, 1 Drawing Sheet

(56) References Cited

U.S. PATENT DOCUMENTS

| | | | |
|---|---|---|---|
| 5,346,797 | A | 9/1994 | Kmiecik-Lawrynowicz et al. |
| 5,368,972 | A | 11/1994 | Yamashita et al. |
| 5,541,031 | A | 7/1996 | Yamashita et al. |
| 5,576,393 | A | 11/1996 | Yamashita et al. |
| 6,140,000 | A | 10/2000 | Yamashita |
| 6,329,115 | B1 | 12/2001 | Yamashita |
| 6,403,275 | B1 | 6/2002 | Kuramoto et al. |
| 6,416,914 | B1 | 7/2002 | Nakamura et al. |
| 6,632,579 | B1 | 10/2003 | Yamashita |
| 7,214,461 | B2 | 5/2007 | Yamashita et al. |
| 7,374,851 | B2 | 5/2008 | Nakayama et al. |
| 8,673,528 | B2 | 3/2014 | Sugimoto et al. |
| 8,735,037 | B2 | 5/2014 | Yamashita et al. |
| 2003/0077536 | A1 | 4/2003 | Yamashita et al. |
| 2003/0162112 | A1 | 8/2003 | Yamashita et al. |
| 2003/0219669 | A1 | 11/2003 | Yamashita et al. |
| 2005/0112488 | A1 | 5/2005 | Yamada et al. |
| 2005/0196692 | A1 | 9/2005 | Yamashita et al. |
| 2006/0068312 | A1 | 3/2006 | Yamashita et al. |
| 2006/0177756 | A1 | 8/2006 | Sugimoto et al. |
| 2007/0015077 | A1 | 1/2007 | Yamashita et al. |
| 2008/0070151 | A1 | 3/2008 | Sugimoto et al. |
| 2008/0118855 | A1 | 5/2008 | Nakayama et al. |
| 2008/0233498 | A1 | 9/2008 | Yamada et al. |
| 2008/0261131 | A1 | 10/2008 | Nakayama et al. |
| 2008/0268366 | A1 | 10/2008 | Nakayama et al. |
| 2008/0280219 | A1 | 11/2008 | Nakayama et al. |
| 2008/0318143 | A1 | 12/2008 | Nakayama et al. |
| 2008/0318148 | A1 | 12/2008 | Sugimoto et al. |
| 2009/0092917 | A1 | 4/2009 | Sugimoto et al. |
| 2009/0214973 | A1 | 8/2009 | Sugimoto et al. |
| 2010/0035170 | A1 | 2/2010 | Sugimoto et al. |
| 2010/0178604 | A1* | 7/2010 | Lee ..... G03G 9/0804 430/108.4 |
| 2011/0294058 | A1 | 12/2011 | Shiba et al. |
| 2012/0282000 | A1 | 11/2012 | Nakayama et al. |
| 2012/0295193 | A1 | 11/2012 | Hanatani et al. |
| 2013/0045442 | A1 | 2/2013 | Moriya et al. |
| 2013/0059247 | A1 | 3/2013 | Sugimoto et al. |
| 2013/0078563 | A1 | 3/2013 | Nakayama et al. |
| 2013/0095422 | A1 | 4/2013 | Yamamoto et al. |
| 2013/0108950 | A1 | 5/2013 | Yamamoto et al. |
| 2013/0115550 | A1 | 5/2013 | Amemori et al. |
| 2013/0130171 | A1 | 5/2013 | Watanabe et al. |
| 2013/0143155 | A1 | 6/2013 | Santo et al. |
| 2013/0157183 | A1 | 6/2013 | Santo et al. |
| 2013/0157185 | A1 | 6/2013 | Sakashita et al. |
| 2013/0157193 | A1 | 6/2013 | Moritani et al. |
| 2013/0236826 | A1 | 9/2013 | Makabe et al. |
| 2013/0244011 | A1 | 9/2013 | Sabu et al. |
| 2013/0244153 | A1 | 9/2013 | Nakayama et al. |
| 2013/0244154 | A1 | 9/2013 | Yamamoto et al. |
| 2013/0244168 | A1 | 9/2013 | Yamashita et al. |
| 2013/0252158 | A1 | 9/2013 | Yamada et al. |
| 2013/0260298 | A1 | 10/2013 | Amemori et al. |
| 2013/0330522 | A1 | 12/2013 | Suzuki et al. |
| 2013/0337374 | A1 | 12/2013 | Sugimoto et al. |
| 2013/0337376 | A1 | 12/2013 | Watanabe et al. |
| 2014/0023965 | A1 | 1/2014 | Chiba et al. |
| 2014/0051019 | A1 | 2/2014 | Sekiguchi et al. |
| 2014/0065534 | A1 | 3/2014 | Amemori et al. |
| 2014/0080046 | A1 | 3/2014 | Asahina et al. |
| 2014/0080047 | A1 | 3/2014 | Takahashi et al. |
| 2014/0080050 | A1 | 3/2014 | Asahina et al. |
| 2014/0242514 | A1 | 8/2014 | Inoue et al. |
| 2014/0270874 | A1 | 9/2014 | Hase et al. |
| 2014/0272689 | A1 | 9/2014 | Yamashita et al. |
| 2014/0272695 | A1 | 9/2014 | Moritani et al. |
| 2014/0272696 | A1 | 9/2014 | Yamashita et al. |
| 2014/0301757 | A1 | 10/2014 | Sakashita et al. |

FOREIGN PATENT DOCUMENTS

| | | | |
|---|---|---|---|
| JP | 11-133665 | A | 5/1999 |
| JP | 2000-275907 | A | 10/2000 |
| JP | 2001-305797 | A | 11/2001 |
| JP | 2002-287400 | A | 10/2002 |
| JP | 2002-351143 | A | 12/2002 |
| JP | 2005-077776 | A | 3/2005 |
| JP | 2006-267741 | A | 10/2006 |
| JP | 2013-054178 | A | 3/2013 |

OTHER PUBLICATIONS

U.S. Appl. No. 14/274,875, filed May 12, 2014.
U.S. Appl. No. 08/165,101, filed Dec. 10, 1993.

* cited by examiner

MAGENTA TONER, DEVELOPER, AND IMAGE FORMING APPARATUS

BACKGROUND OF THE INVENTION

1. Field of the Invention

The present invention relates to a magenta toner containing a resin for a toner, and a colorant, and a developer and an image forming apparatus using the magenta toner.

2. Description of the Related Art

On the recent market, there have been requirements for downsizing of particle diameters of toners for increasing image quality of images, and for low temperature fixing ability of toners for energy saving. In particular, for energy saving, it is desirable to make an amount of power the lowest possible that is required for a waiting time from when an image forming apparatus is set up to be usable to when image forming is possible (i.e., a warm-up time of an apparatus) and there has been strong demand for shortening the waiting time. Toners obtained by a generally used knead-pulverizing method, however, have been becoming close to the technical limitation for downsizing of their particle diameters, involving various problems such as their amorphous shapes, broad particle size distributions, and high fixing energy required. Particularly in fixing, kneaded-pulverized toner particles produced by a pulverization method crack at the interface with a release agent during pulverization, so that the release agent is present more on their surfaces and easily exhibits its releasing effects. On the other hand, the release agent easily adheres to a carrier or a photoconductor and also to a blade, and such toner particles have not been satisfactory in performances.

In order to overcome the problems with the above knead-pulverizing method, there have been proposed methods for producing a toner based on the polymerization method. This polymerization method enables the toner to be easily downsized in particle diameters, to have a sharper particle size distribution than toner produced by the pulverization method, and to enclose a release agent therein. For example, Japanese Patent Application Laid-Open (JP-A) Nos. 63-282752 and 06-250439 propose methods for producing toner by the emulsion polymerization aggregation method. Also, JP-A Nos. 2000-275907 and 2001-305797 propose techniques that overcome the problems associated with use of a surfactant in the emulsion polymerization aggregation method. Furthermore, JP-A No. 11-133665 proposes a dry toner having a working sphericity of 0.90 to 1.00 using an elongation reaction product of urethane-modified polyester as a toner binder, in order to improve toners in flowability, low temperature fixing ability, and hot offset resistance. Moreover, JP-A Nos. 2002-287400 and 2002-351143 propose a dry toner excellent in all of powder flowability, transferability, heat resistant storage stability, low temperature fixing ability, hot offset resistance when it is formed into a toner having a small particle diameter. Any of these production methods of toner includes a polymerizing step of performing polyaddition reaction between an isocyanate group-containing polyester prepolymer and an amine in an organic solvent and an aqueous medium; and a step of removing the organic solvent by heating etc. In particular, JP-A No. 2005-77776 describes the method of removal of the organic solvent in detail.

These conventional polymerization toners, however, are produced in water, and thus are attached with, for example, soap, particles, and aqueous polymers during the production of toner particles, which makes the resultant toner poor in melting property, adhesion property between toner particles, adhesion property of toner particles on paper upon fixing, so that it is not possible to achieve favorable color properties on paper.

Meanwhile, JP-A No. 2006-267741 discloses a toner containing a naphthol pigment and a quinacridone pigment having specific X-ray diffraction patterns. These pigments, however, use a crystalline substance having a narrow half value width and high crystallinity, and the crystals are hard and large. That is why they are difficult to disperse in the toner to make it impossible to show appropriate density and hue. In addition, pigments to be used in magenta toners have properties of easily localizing at the toner surface, and there has been a problem that they inhibit thermal conduction to toner upon fixing.

SUMMARY OF THE INVENTION

An object of the present invention is to provide a magenta toner excellent in color reproducibility, heat resistant storage stability, and low temperature fixing ability, and capable of solving the above problems.

The above problems are solved by an invention described in 1) below. That is, 1) a magenta toner for electrophotography, including:

a polyester resin; and a colorant containing a naphthol-based pigment, wherein the magenta toner for electrophotography satisfies requirements <1> and <2> below:

<1>[G'(100) (THF insoluble matter)] is $1.0\times10^5$ Pa to $1.0\times10^7$ Pa, and a ratio of [G'(40) (THF insoluble matter)] to the [G'(100) (THF insoluble matter)] is 3.5×10 or less, where the [G'(100) (THF insoluble matter)] is a storage modulus at 100° C. of THF insoluble matter of the toner and the [G'(40) (THF insoluble matter)] is a storage modulus at 40° C. of the THF insoluble matter of the toner; and <2> an X-ray diffraction pattern of the naphthol-based pigment in a crystalline state has a plurality of peaks in a range of $0°\leq2\theta\leq35°$, and a sum of half value widths of the peaks is 5° to 10°.

According to the present invention, it is possible to provide a magenta toner excellent in color reproducibility, heat resistant storage stability, and low temperature fixing ability, and capable of solving the above problems.

DETAILED DESCRIPTION OF THE INVENTION

Figure 1:
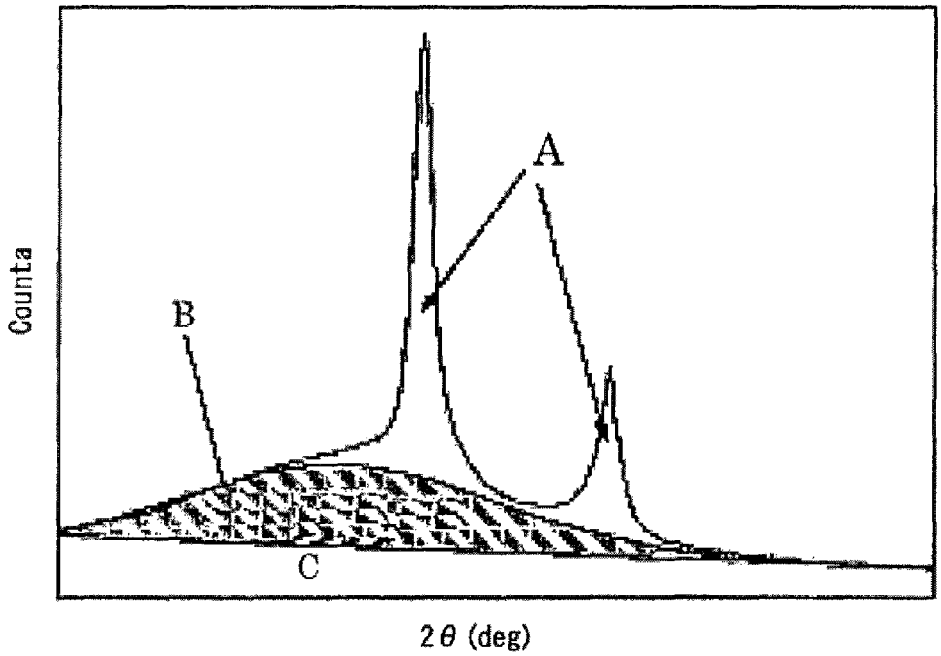
FIG. 1 is a chart of one example of an X-ray diffraction pattern.

Hereinafter, the present invention 1) will be described in detail, but embodiments of the present invention also include the following 2) to 9), which will be described as well.

2) The magenta toner according to 1), wherein 50% by mass or less of the naphthol-based pigment is present within a region of 1,000 nm from a surface of the toner toward a center thereof.

3) The magenta toner according to 1) or 2), wherein the magenta toner has a glass transition temperature (Tg1st) of 20° C. to 50° C., where the glass transition temperature (Tg1st) is measured in first heating of differential scanning calorimetry (DSC).

4) The magenta toner according to any one of 1) to 3), wherein the magenta toner has a glass transition temperature (Tg2nd) of 0° C. to 30° C., where the glass transition temperature (Tg2nd) is measured in second heating of differential scanning calorimetry (DSC).

5) The magenta toner according to any one of 1) to 4), wherein the polyester resin contains a non-crystalline polyester resin insoluble in THF and a polyester resin soluble in THF.

6) The magenta toner according to 5), wherein the non-crystalline polyester resin insoluble in THF has a Tg of 20° C. or lower.

7) The magenta toner according to any one of 1) to 6), wherein the polyester resin further contains a crystalline polyester resin.

8) A developer, including:

the magenta toner according to any one of 1) to 7); and a carrier.

9) An image forming apparatus, including:

an electrostatic latent image bearer;

an electrostatic latent image forming unit configured to form an electrostatic latent image on the electrostatic latent image bearer; and a developing unit configured to develop the electrostatic latent image formed on the electrostatic latent image bearer with a toner to form a visible image, wherein the toner is the magenta toner according to any one of 1) to 7).

The values of the [G'(100) (THF insoluble matter)] and the [G'(40) (THF insoluble matter)] can be adjusted by changing the resin composition (bi- or more functional polyol and bi- or more functional acid component).

Specifically, they may be adjusted in the following manner, for example.

The G' can be increased by shortening the ester bond in the resin, or having the resin composition contain an aromatic ring.

The G' can be decreased by using a linear polyester resin, or a polyol having an alkyl group in a side chain thereof as a constituent component of the resin.

<THF Insoluble Matter>

An amount of THF (tetrahydrofuran) insoluble matter of the magenta toner (hereinafter may be referred to as "toner") of the present invention is not particularly limited and may be appropriately selected depending on the intended purpose. It is preferably 15% by mass to 35% by mass, more preferably 20% by mass to 30% by mass. When the THF insoluble matter is less than 15% by mass, the toner may be reduced in low temperature fixing ability, whereas when it is more than 35% by mass, the toner may be degraded in heat resistant storage stability.

The THF insoluble matter corresponds mainly to non-linear, non-crystalline polyester resin A described below. The toner of the present invention has a lower Tg than the conventional toners, but when the THF insoluble matter is contained in a specific amount, the toner can sufficiently retain heat resistant storage stability. In particular, the non-linear, non-crystalline polyester resin A has a urethane bond or a urea bond responsible for high aggregation force, the effect of retaining heat resistant storage stability will be more significant.

The THF insoluble matter can be obtained as follows. Specifically, 1 part of the toner is added to 40 parts of THF. The mixture is refluxed for 6 hours. Thereafter, insoluble matter is precipitated with a centrifugal separator, and the supernatant is separated from the insoluble matter, which is then dried at 40° C. for 20 hours.

<Storage Modulus of THF Insoluble Matter>

<<[G'(100) (THF insoluble matter)] and [[G'(40) (THF insoluble matter)]/[G'(100) (THF insoluble matter)]]>>

The storage modulus at 100° C. of THF insoluble matter of the toner of the present invention, [G'(100) (THF insoluble matter)], has to be $1.0\times10^5$ Pa to $1.0\times10^7$ Pa, but it is preferably $5.0\times10^5$ Pa to $5.0\times10^6$ Pa.

The ratio of the storage modulus at 40° C. of THF insoluble matter of the toner of the present invention to the [G'(100) (THF insoluble matter)], [[G'(40) (THF insoluble matter)]/[G'(100) (THF insoluble matter)]], has to be 3.5×10 or less, but it is preferably 3.3×10 or less. The lower limit of the above ratio is not particularly limited and may be appropriately selected depending on the intended purpose, but is preferably 2.0×10 or more.

In the toner of the present invention which satisfies the requirement <1> for its storage modulus, compatibility between a crystalline polyester resin C and the non-linear, non-crystalline polyester resin A which is a high Tg component is enhanced, so that a ½ flow onset temperature as measured with a thermal flow evaluator (flow tester) decreases and image gloss is improved.

<Glass transition temperature (Tg)>

<<[Tg1st]>>

The toner of the present invention preferably has the glass transition temperature [Tg1st] of 20° C. to 50° C., more preferably 35° C. to 45° C., where the glass transition temperature (Tg1st) is measured in first heating of differential scanning calorimetry (DSC).

If the Tg of a conventional toner is lowered to be about 50° C. or lower, the conventional toner tends to cause aggregation of toner particles influenced by temperature variations during transportation or storage of the toner in summer or in a tropical region. As a result, the toner is solidified in a toner bottle, or within a developing unit. Moreover, supply failures due to clogging of the toner in the toner bottle, and formation of defected images due to toner adherence are likely to occur.

The toner of the present invention has a lower Tg than conventional toners, but can maintain its heat resistant storage stability by the action of the above-described non-linear, non-crystalline polyester resin A.

When the [Tg1st] is lower than 20° C., the toner has poor heat resistant storage stability, causes blocking within a developing unit, and causes filming on a photoconductor. When it is higher than 50° C., the toner has poor low temperature fixing ability.

<<[Tg2nd]>>

In the toner of the present invention, the [Tg2nd], which is the glass transition temperature measured in second heating of differential scanning calorimetry (DSC), is not particularly limited and may be appropriately selected depending on the intended purpose. It is preferably 0° C. to 30° C., more preferably 15° C. to 30° C.

When the [Tg2nd] is lower than 0° C., the fixed image (printed matter) may be degraded in blocking resistance, whereas when it is higher than 30° C., sufficient low temperature fixing ability and glossiness may not be obtained.

The [Tg2nd] can be adjusted by, for example, the Tg and amount of the crystalline polyester resin C.

<<[G'(100) (toner)]>>

A storage modulus at 100° C. of the toner of the present invention, [G'(100) (toner)], is preferably $5.0\times10^3$ Pa to $5.0\times10^4$ Pa. When the [G'(100) (toner)] is less than $5.0\times10^3$ Pa, hot offset may occur. When it is more than $5.0\times10^4$ Pa, the lowest fixable temperature may increase.

The value of the [G'(100) (toner)] can be adjusted by, for example, the composition of the non-linear, non-crystalline polyester resin A.

<Melting Point>

The melting point of the toner of the present invention is not particularly limited and may be appropriately selected depending on the intended purpose. It is preferably 60° C. to 80° C.

<Naphthol-Based Pigment>

A naphthol-based magenta pigment is effective to attain high image density in electrophotography and realize a desired range of color. It has, however, drawbacks that are poor dispersibility in a toner resin and strongly reddish color. The present inventors, however, have found that by realizing an appropriate crystalline state of the naphthol-based pigment, it is possible to improve its dispersibility to assume a bluish hue.

A crystalline state can be presumed based on, for example, diffraction angles, widths and intensities of peaks in X-ray diffraction. In the present invention, however, it is required that a plurality of peaks be co-present with specific widths and intensities; i.e., the naphthol-based pigment is required to have a plurality of peaks in a range of $0° \leq 2\theta \leq 35$ where a sum of half value widths of the peaks is 5° to 10°. Note that, the half value width refers to a width of a peak at half the peak intensity.

Also, a target color in the present invention is preferably −7 or more but less than −5 in b* when a* is 70 or more but less than 75 and is −5 or more but less than −3 in b* when a* is 75 or more but less than 80 in a CIE Lab of an image obtained by performing image formation on a gloss paper sheet using the magenta toner alone at a deposition amount of 0.30 mg/cm$^2$ or less.

The CIE Lab can be measured using, for example, X-RITE938 (product of Xrite Co.). Conditions for the measurement are, for example, the following conditions.

Light source: D50

Measurement light: 0° light receiving angle, 45° light irradiating angle

Measurement color: 2° field of view

Measurement performed with 10 sheets of gloss paper stacked

Examples of the naphthol-based pigment used in the present invention include compounds represented by the following General Formula (1). These can be obtained through coupling reaction between corresponding diazonium salts and naphthol compounds. Among them, compounds represented by the following formula (B) are preferred.

Specific examples thereof include Pigment Red 184 and Pigment Red 269 used in Examples, but usable compounds are not limited thereto and may be appropriately selected from known compounds.

General Formula (1)

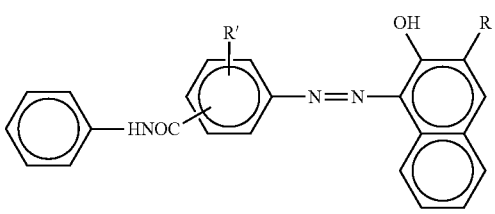

In the above formula R represents any one of the groups represented by the following formulas (A) and R' is a hydrogen atom, an alkyl group, or a methoxy group.

(A)

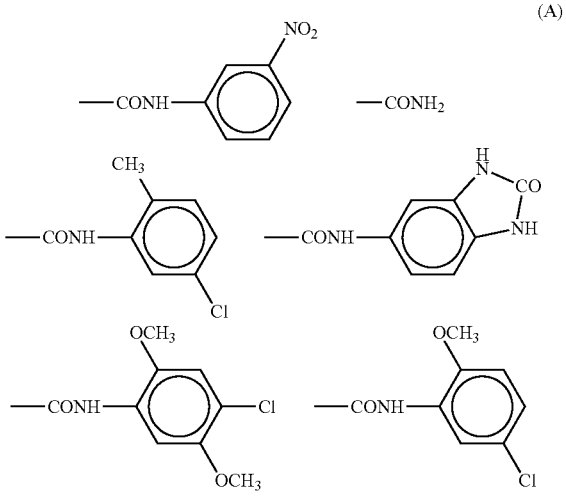

(B)

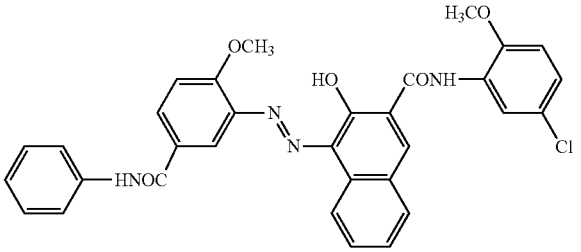

Preferable examples of these compounds include those in Tab18 on P289 whose shades are red, bluish red and carmine described in Industrial Organic Pigments Second Edition written by W. Herbest and K. Hunger (A Wiley company Publishing, 1997).

In order to satisfy the requirement <2> regarding the crystalline state of the naphthol-based pigment, importance is placed on synthesis conditions for controlling a primary particle diameter and uniformity of the pigment.

Specifically, in the coupling reaction between diazonium salts and naphthol compounds, the pH of its reaction field is controlled to 10 to 12. Also, if necessary, an additive may be added for controlling a particle diameter. Examples of such additives include rosin resins, was, surfactants, and colloidal metal oxides in the form of particles (particle diameter: 100 nm or less). Other important factors are reaction temperature and purification conditions.

An amount of the naphthol pigment is preferably 3 parts by mass to 20 parts by mass relative to 100 parts by mass of the toner. Also, when Pigment Red 269 is used as the naphthol pigment, its amount is preferably 5 parts by mass to 15 parts by mass.

<Magenta Pigments Other than the Naphthol-Based Pigment>

Magenta pigments usable as a mixture with the naphthol-based pigment are, for example, quinacridone-based colorant represented by the following General Formula (2).

Among them, C.I. Pigment Red 122, C.I. Pigment Red 202, or C.I. Pigment Violet 19 (which are the names described in Color Index Vol. 4) are preferable in terms of hue and physical stabilities such as lightfastness.

General Formula (2)

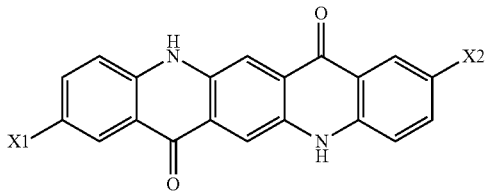

In the above formula, X1 and X2 each independently represent a hydrogen atom, a halogen atom, an alkyl group, or an alkoxy group.

In addition, the following commonly-used magenta pigments may be used in combination: colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, etc.

<Method for Confirming a Localized State of the Pigment>

In the present invention, 50% by mass or less of the naphthol-based pigment is present within a region of 1,000 nm from a surface of the toner toward a center thereof.

Such a localized state of the pigment is examined as follows. Specifically, an ultra-thin section of the toner is prepared, and observed under a TEM (transmission electron microscope) at a magnitude of×100,000 to obtain an image. The obtained image is binarized through image processing, and the area occupied by the pigment is examined as S1, which is an area of the pigment within 1,000 nm from the uppermost surface, and S2, which is an area of the pigment present in the other region (inner region).

One requirement of the present invention is S1/(S1+S2) ≤0.5. This value can be obtained by examining images of randomly selected 10 toner particles having the maximum diameter of the volume average particle diameter±10%, followed by averaging.

X-ray diffraction measurement of the naphthol pigment is performed under the following conditions using a horizontal sample stage-type strong X-ray diffractometer (RINT TTRII) (product of Rigaku Corporation).

A sample for X-ray diffraction measurement is prepared as follows. Specifically, an exclusive sample holder is used and the naphthol pigment is uniformly charged to a hole or groove in a sample-charging portion thereof, followed by being pressed with a glass plate or the like so that the surface of the sample holder and the surface of the sample become at the same level.

[Measurement Conditions of X-Ray Diffraction]

Bulb: Cu
Parallel beam optical system
Voltage: 50 kV
Current: 300 mA
Start angle: 0°
End angle: 35°
Step width: 0.02°
Scan speed: 1.00°/min
Diffusion slit: open
Diffusion longitudinal limit slit: 10 mm
Scattering slit: open
Light-receiving slit: open

[Integral Intensity of Diffraction Peaks]

Integral intensities of various peaks in the obtained X-ray diffraction pattern are determined by calculating their peak areas using analysis software "jade6" (product of Rigaku Corporation). The calculation method will be described using one example of an X-ray diffraction pattern shown in FIG. 1.

In FIG. 1, "A" means the area of a crystalline component, "B" means the area of a non-crystalline component, and "C" means the area of a background.

Specifically, with the Blagg angle being 0, peak separation is performed in the range of 0°≤2θ≤35°, and the peak areas are calculated according to the procedure (1) to (5):

(1) the total area under the separated X-ray diffraction curves is calculated;

(2) a straight line is drawn to connect the lowest angle with the highest angle on the diffraction curve, and the area under the straight line is calculated and used as a background;

(3) in order to separate the non-crystalline component from the diffraction curve from which the background has been subtracted, the diffraction pattern (halo pattern) derived from the non-crystalline components is designated to be the lower angle side;

(4) in order to separate the diffraction curves, the respective crystalline diffraction peaks are designated similar to the non-crystalline component; and (5) fitting is performed on the diffraction curves of the non-crystalline component and the respective crystalline components designated in the above (3) and (4), and the areas under the curves are calculated.

Calculation formulas are as follows.

Total integral intensity (Ia)=total area within a predetermined range−area of background Integral intensity of peaks (Ib)=(Ia)−area of non-crystalline component Integral intensity of diffraction peak (P2) (Ic)=area of (P2) in the integral intensity of peaks (Ib)

<Pigment Dispersion>

The toner is prepared using a pigment dispersion. The pigment dispersion preferably contains a magenta pigment in an amount of 30 parts by mass to 70 parts by mass relative to 100 parts by mass of the total solid content of the non-crystalline resin and the pigment dispersion. When the amount of the magenta pigment is less than 30 parts by mass, a large amount of the dispersion is needed, which is not economically preferable. When it exceeds 70 parts by mass, there may be degradation in dispersibility of the pigment.

An amount of the magenta pigment in the toner is not particularly limited and may be appropriately selected depending on the intended purpose. It is preferably 2.0 parts by mass to 10.0 parts by mass, more preferably 4.0 parts by mass to 8.0 parts by mass, particularly preferably 5.0 parts by mass to 7.0 parts by mass, relative to 100 parts by mass of the toner.

The pigment dispersion preferably contains a release agent from the viewpoint of increasing wettability of the pigment to a resin of a materbatch (pigment dispersion) to assist dispersibility of the pigment.

The pigment dispersion can be obtained by mixing and kneading the resin for materbatch, the magenta pigment, and the release agent under application of high sheering force. At this time, an organic solvent may be used for increasing interaction between the magenta pigment and the resin. For the mixing and kneading, high shearing dispersers such as a three roller mill are preferably used.

The resin for materbatch is not particularly limited and may be appropriately selected depending on the intended purpose. Examples thereof include non-crystalline resins.

<Non-Crystalline Resin>

The non-crystalline resin is not particularly limited and may be appropriately selected depending on the intended purpose. Examples thereof include polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylate resins; polybutyl methacrylate resins; polyvinyl chloride resins; polyvinyl acetate resins; polyethylene resins; polypropylene resins; epoxy resins; epoxy polyol resins; polyurethane resins; polyamide resins; polyvinyl butyral resins; polyacrylic acid resins; rosin; modified rosin; terpene resins; aliphatic or alicyclic hydrocarbon resins; and aromatic petroleum resins.

These may be used alone or in combination.

Among them, polyester resins are preferable since use of them can provide images of high glossiness and they are excellent in low temperature fixing ability and heat resistant storage stability.

The non-crystalline resin is preferably incompatible to acrylic resin particles described below. For this reason, the non-crystalline resin is preferably a polyester resin. When the acrylic resin particles are particles of crosslinked resins containing an acrylic acid ester polymer or a methacrylic acid ester polymer, the polyester resin is preferable since it is hardly compatible to these crosslinked resins.

In an emulsification step in the production of the magenta toner, when acrylic resin particles are added before or after emulsification, the acrylic resin particles may dissolve after being attached onto the surfaces of liquid droplets of toner materials due to the organic solvent present in the liquid droplets. When the resin component constituting the magenta toner is a polyester resin and the acrylic resin particles are particles of crosslinked resins containing an acrylic acid ester polymer or a methacrylic acid ester polymer, the acrylic resin particles are present in a state where they are attached onto the liquid droplets of the toner particles without being compatible thereto due to poor compatibility between the resins. Therefore, use of the non-crystalline resin can realize a desired state where it enters the surfaces of the liquid droplets to some extent and then is attached and fixed on the toner surfaces after removal of the organic solvent.

Whether certain resins are compatible or incompatible to each other is determined as follows. Specifically, an unmodified, non-crystalline resin is dissolved in an organic solvent in an amount of 50% by mass. Various solutions are added to the resultant solution, and the resultant solutions are visually observed to judge that they are incompatible when there are two separate layers formed and that they are compatible when there are no separate layers formed.

<Non-Linear, Non-Crystalline Polyester Resin A>

The non-linear, non-crystalline polyester resin A is a resin that is insoluble in THF. Any resin may be used as the non-linear, non-crystalline polyester resin A so long as it satisfies the requirements of the present invention. However, it is desirably a resin having rubber elasticity under an environment of normal temperature. Therefore, the non-crystalline polyester resin A has a crosslinked structure, has a glass transition temperature (Tg) in a low temperature range of 20° C. or lower, and shows such viscoelastic behaviors that it is in a rubber-like state under an environment of room temperature or higher. The non-crystalline polyester resin A is preferably one obtained through reaction between a non-linear, reactive precursor and a curing agent.

The non-crystalline polyester resin A preferably contains at least one of a urethane bond and a urea bond since it is possible to obtain more excellent adhesion to recording media such as paper. The urethane bond or urea bond behaves as pseudo-crosslinked points, and the non-crystalline polyester resin A exhibits stronger rubber-like properties, further improving the toner in heat resistant storage stability and high temperature offset resistance.

The non-linear, reactive precursor is not particularly limited and may be appropriately selected depending on the intended purpose so long as it is a polyester resin containing a group reactive with a curing agent (hereinafter may be referred to as "prepolymer").

Examples of the group reactive with the curing agent in the prepolymer include a group reactive with an active hydrogen group. Examples thereof include an isocyanate group, an epoxy group, a carboxylic acid group, and an acid chloride group. Among them, the isocyanate group is preferable because it is possible to introduce a urethane bond and/or a urea bond to the non-linear, non-crystalline polyester resin A. Moreover, as the prepolymer, an isocyanate group-containing polyester resin is preferable.

The isocyanate group-containing polyester resin is not particularly limited and may be appropriately selected depending on the intended purpose. Examples thereof include a reaction product between an active hydrogen group-containing polyester resin and a polyisocyanate.

The active hydrogen group-containing polyester resin can be obtained by polycondensation of, for example, diol, dicarboxylic acid and trihydric or more alcohol and/or trivalent or more carboxylic acid. The trihydric or more alcohol and the trivalent or more carboxylic acid give a branched structure to the isocyanate group-containing polyester.

The diol is not particularly limited and may be appropriately selected depending on the intended purpose. Examples thereof include aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; an oxyalkylene group-containing diols such as diethylene glycol, triethylene glycol, dipropylene glycol, polyethylene glycol, polypropylene glycol and polytetramethylene glycol; alicyclic diols such as 1,4-cyclohexanedimethanol and hydrogenated bisphenol A; adducts of alicyclic diols with alkylene oxides such as ethylene oxide, propylene oxide, and butylene oxide; bisphenols such as bisphenol A, bisphenol F and bisphenol S; and adducts of bisphenols with alkylene oxides such as ethylene oxide, propylene oxide, and butylene oxide. Among them, aliphatic diols having 4 to 12 carbon atoms are preferred.

These diols may be used alone or in combination of two or more thereof.

The dicarboxylic acid component is not particularly limited and may be appropriately selected depending on the intended purpose. Examples thereof include aliphatic dicarboxylic acids and aromatic dicarboxylic acids. Besides, anhydrides thereof, lower (C1-C3) alkyl ester compounds thereof, or halides thereof may also be used.

Examples of the aliphatic dicarboxylic acid include succinic acid, adipic acid, sebacic acid, decanedioic acid, maleic acid, and fumaric acid.

Examples of the aromatic dicarboxylic acid include a aromatic dicarboxylic acid having 8 to 20 carbon atoms. Examples thereof include phthalic acid, isophthalic acid, terephthalic acid, and naphthalenedicarboxylic acid.

Among them, aliphatic dicarboxylic acids having 4 to 12 carbon atoms are preferred.

These dicarboxylic acids may be used alone or in combination of two or more thereof.

The trihydric or more alcohol is not particularly limited and may be appropriately selected depending on the intended purpose. Examples thereof include trihydric or more aliphatic alcohol, trihydric or more polyphenols, and alkylene oxide adduct of trihydric or more polyphenols.

Examples of the trihydric or more aliphatic alcohol include glycerin, trimethylolethane, trimethylolpropan, pentaerythritol, and sorbitol.

Examples of the trihydric or more polyphenols include trisphenol PA, phenol novolak, cresol novolak.

Examples of the alkylene oxide adduct of trihydric or more polyphenols include adducts of trihydric or more polyphenols with alkylene oxide such as ethylene oxide, propylene oxide, and butylene oxide.

The trivalent or more carboxylic acid is not particularly limited and may be appropriately selected depending on the intended purpose. Examples thereof include trivalent or more aromatic carboxylic acid. Alternatively, anhydrides thereof, lower (C1-C3) alkyl ester compounds thereof, or halides thereof may also be used.

As the trivalent or more aromatic carboxylic acid, trivalent aromatic carbolic acid having 9 to 20 carbon atoms is preferable. Examples thereof include trimellitic acid and pyromellitic acid.

The polyisocyanate is not particularly limited and may be appropriately selected depending on the intended purpose. Examples thereof include diisocyanate, and trivalent or more isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is not particularly limited and may be appropriately selected depending on the intended purpose. Examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate is not particularly limited and may be appropriately selected depending on the intended purpose. Examples thereof include α,α,α',α'-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination of two or more thereof.

The curing agent is not particularly limited and may be appropriately selected depending on the intended purpose so long as it reacts with the non-linear, reactive precursor, and produces the non-linear, non-crystalline polyester resin A. Examples thereof include an active hydrogen group-containing compound.

Examples of the active hydrogen group in the active hydrogen group-containing compound include a hydroxyl group (e.g., an alcoholic hydroxyl group, and a phenolic hydroxyl group), an amino group, a carboxyl group, and a mercapto group. These may be used alone or in combination of two or more thereof.

The active hydrogen group-containing compound is preferably selected from amines, as the amines can form a urea bond.

Examples of the amines include diamine, trivalent or more amine, amino alcohol, amino mercaptan, amino acid, and compounds in which the amino groups of the foregoing compounds are blocked. These may be used alone or in combination of two or more thereof.

Among them, diamine, and a mixture of diamine and a small amount of trivalent or more amine are preferable.

Examples of the diamine include aromatic diamine, alicyclic diamine, and aliphatic diamine.

Examples of the aromatic diamine include phenylenediamine, diethyl toluene diamine, and 4,4'-diaminodiphenylmethane.

Examples of the alicyclic diamine include 4,4'-diamino-3,3'-dimethyldicyclohexyl methane, diaminocyclohexane, and isophoronediamine.

Examples of the aliphatic diamine include ethylene diamine, tetramethylene diamine, and hexamethylenediamine.

Examples of the trivalent or more amine include diethylenetriamine, and triethylene tetramine.

Examples of the amino alcohol include ethanol amine, and hydroxyethyl aniline.

Examples of the aminomercaptan include aminoethyl mercaptan, and aminopropyl mercaptan.

Examples of the amino acid include aminopropionic acid, and aminocaproic acid.

Examples of the compound where the amino group is blocked include a ketimine compound where the amino group is blocked with ketone such as acetone, methyl ethyl ketone, methyl isobutyl ketone, and an oxazoline compound.

The non-linear, non-crystalline polyester resin A preferably satisfies any of the following (a) to (c) in order to be lower Tg thereof and in order to easily impart a property of deforming at a low temperature.

(a) The non-linear, non-crystalline polyester resin A contains a diol component as the constituent component thereof, where the diol component contains an aliphatic diol having 4 to 12 carbon atoms in an amount of 50% by mass or more.

(b) The non-linear, non-crystalline polyester resin A contains an aliphatic diol having 4 to 12 carbon atoms in an amount of 50% by mass or more, in the total alcohol component.

(c) The non-linear, non-crystalline polyester resin A contains a dicarboxylic acid component as the constituent component thereof, where the dicarboxylic acid component contains an aliphatic dicarboxylic acid having 4 to 12 carbon atoms in an amount of 50% by mass or more.

A Tg of the non-linear, non-crystalline polyester resin A is preferably −60° C. to 0° C., more preferably −40° C. to −20° C. When the Tg thereof is less than −60° C., the flow of the toner can not be controlled at a low temperature, and heat resistant storage stability and filming resistance tend to deteriorate. When the Tg thereof is more than 0° C., the deformation of the toner with heat and pressurization during fixing may be insufficient, and low temperature fixing ability tends to be insufficient.

A weight average molecular weight of the non-linear, non-crystalline polyester resin A is not particularly limited and may be appropriately selected depending on the intended purpose, but it is preferably 20,000 to 100,000 as measured by GPC (gel permeation chromatography). When the weight average molecular weight is less than 20,000, a resulting toner is likely to flow at a low temperature. In addition, heat resistant storage stability may be impaired, and a viscosity may lower during melting the toner, which may impair high temperature offset property. When it is more then 100,000, the Tg of the toner may be high, which may deteriorate minimum fixing temperature.

A molecular structure of the non-linear, non-crystalline polyester resin A can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on 6CH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-linear, non-crystalline polyester resin A is not particularly limited and may be appropriately selected depending on the intended purpose, but it is preferably 5 parts by mass to 25 parts by mass, more preferably 10 parts by mass to 20 parts by mass, relative to 100 parts by mass of the toner. When the amount thereof is smaller than 5 parts by mass, low temperature fixing ability, and hot offset resistance of a resulting toner may be impaired. When the amount thereof is greater than 25 parts by mass, heat resistant storage stability of the toner may be impaired, and glossiness of an image obtained after fixing may be reduced. When the amount thereof is within the aforementioned more preferable range, it is advantageous because all of the low temperature fixing ability, hot offset resistance, and heat resistant storage stability excel.

<Non-Crystalline Polyester Resin B>

A Tg of the non-crystalline polyester resin B is preferably higher than a Tg of the non-crystalline polyester resin A. Tg of the non-crystalline polyester resin B is not particularly limited and may be appropriately selected depending on the intended purpose so long as Tg thereof is 40° C. to 80° C. In addition, the non-crystalline polyester resin B is preferably soluble in THF.

As the non-crystalline polyester resin B, an unmodified polyester resin is preferable. In this case, the unmodified polyester resin is a polyester resin obtained by using polyhydric alcohol, and multivalent carboxylic acids such as multivalent carboxylic acid, multivalent carboxylic acid anhydride, multivalent carboxylic acid ester, or derivatives thereof, and is a polyester resin which is not modified by isocyanate compounds and the like.

Examples of the polyhydric alcohol include diol.

The diol include alkylene (having 2 to 3 carbon atoms) oxide (average addition molar number is 1 to 10) adduct of bisphenol A such as polyoxypropylene(2.2)-2,2-bis(4-hydroxyphenyl)propane, and polyoxyethylene(2.2)-2,2-bis(4-hydroxyphenyl)propane; ethylenegrycol, propylenegrycol; and hydrogenated bisphenol A, and alkylene (having 2 to 3 carbon atoms) oxide (average addition molar number is 1 to 10) adduct of hydrogenated bisphenol A.

They may be used alone or in combination of two or more.

Examples of the multivalent carboxylic acid include dicarboxylic acid.

Examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid.

These may be used alone or in combination of two or more.

The non-crystalline polyester resin B may contain a trivalent or more carboxylic acid and/or a trivalent or more alcohol at the end of the resin chain in order to adjust acid value and hydroxyl value.

Examples of the trivalent or more carboxylic acid include trimellitic acid, pyromellitic acid, and acid anhydride thereof.

Examples of the trihydric or more alcohol include glycerin, pentaerythritol, and trimethylolpropan.

A molecular weight of the non-crystalline polyester resin B is not particularly limited and may be appropriately selected depending on the intended purpose. However, when the molecular weight thereof is too low, heat resistant storage stability of the toner and durability against stress such as stirring in the developing unit may be deteriorated. When the molecular weight thereof is too high, viscoelasticity of the toner during melting tends to be high, which may deteriorate low temperature fixing ability. The weight average molecular weight (Mw) as measured by GPC is preferably 3,000 to 10,000, more preferably 4,000 to 7,000. The number average molecular weight (Mn) is preferably 1,000 to 4,000, more preferably 1,500 to 3,000. Further, Mw/Mn is 1.0 to 4.0, more preferably 1.0 to 3.5.

The acid value of the non-crystalline polyester resin B is not particularly limited and may be appropriately selected depending on the intended purpose. The acid value thereof is preferably 1 mg to 50 mg KOH/g, more preferably 5 mg to 30 mg KOH/g. When the acid value is 1 mg KOH/g or more, a resulting toner is likely to be negatively charged. In addition, a resulting toner has good affinity between the paper and the toner when fixed on the paper, which may improve low temperature fixing ability. Meanwhile, when the acid value is more than 50 mg KOH/g, a resulting toner may deteriorate charging stability, especially charging stability against environmental change.

The hydroxyl value of the non-crystalline polyester resin B is not particularly limited and may be appropriately selected depending on the intended purpose. The hydroxyl value thereof is preferably 5 mg KOH/g or more.

A Tg of the non-crystalline polyester resin B is preferably 40° C. to 80° C., more preferably 50° C. to 70° C. When the Tg is less than 40° C., heat resistant storage stability of the toner and durability against stress such as stirring in the developing unit may be deteriorated. In addition, filming resistance of the toner may be deteriorated. Meanwhile, when the Tg is more than 80° C., the deformation of the toner with heat and pressurization during fixing may be insufficient, which leads to insufficient low temperature fixing ability.

A molecular structure of the non-crystalline polyester resin B can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on SCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin B is not particularly limited and may be appropriately selected depending on the intended purpose, but it is preferably 50 parts by mass to 90 parts by mass, more preferably 60 parts by mass to 80 parts by mass, relative to 100 parts by mass of the toner. When the amount thereof is less than 50 parts by mass, dispersibility of the pigment and the release agent in the toner may be deteriorated, and fogging and artifact of an image may be caused. Meanwhile, when the amount thereof is more than 90 parts by mass, the amount of the crystalline polyester resin C and the non-linear, non-crystalline polyester resin A are low, which may deteriorate low temperature fixing ability. When the amount thereof is within more preferable range than the aforementioned range, it is advantageous because a resulting toner is excellent in terms of both high image quality and low temperature fixing ability.

When a combination of the non-crystalline polyester resin A and B as described above, is used, it is believed that the non-crystalline polyester resin A has good affinity with both the non-crystalline polyester resin B and the crystalline polyester resin C as described below, and plays a role of enhancing compatibility of the non-crystalline polyester resin B and C. Thus, the polyester resin preferably contains both the non-crystalline polyester resin A and the non-crystalline polyester resin B, and more preferable contains the crystalline polyester resin C.

<Crystalline Polyester Resin C>

Crystalline polyester resin C causes drastic viscosity lowering at temperature around fixing onset temperature, since the crystalline polyester resin C has high crystallinity. By using the crystalline polyester resin C having heat melting characteristics together with the non-crystalline polyester resin B, the heat resistant storage stability of the toner is excellent up to the melt onset temperature owing to crystallinity, and the toner drastically decreases its viscosity (sharp melt properties) at the melt onset temperature because of melting of the crystalline polyester resin C. Along with the drastic decrease in viscosity, the crystalline polyester resin C is melt together with the non-crystalline polyester resin B, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin C is obtained from a polyhydric alcohol and a multivalent carboxylic acid or a derivative thereof such as a multivalent carboxylic acid anhydride and a multivalent carboxylic acid ester.

Note that, in the present invention, the crystalline polyester resin C is one obtained from a polyhydric alcohol and a multivalent carboxylic acid or a derivative thereof such as a multivalent carboxylic acid anhydride and a multivalent carboxylic acid ester, as described above, and a resin obtained by modifying a polyester resin, for example, the aforementioned prepolymer and a resin obtained through cross-link and/or chain elongation reaction of the prepolymer do not belong to the crystalline polyester resin C.

—Polyhydric Alcohol—

The polyhydric alcohol is not particularly limited and may be appropriately selected depending on the intended purpose. Examples thereof include diol, and trihydric or more alcohol.

Examples of the diol include saturated aliphatic diol. Examples of the saturated aliphatic diol include linear chain saturated aliphatic diol, and branched-chain saturated aliphatic diol. Among them, linear chain saturated aliphatic diol is preferable, and a linear chain saturated aliphatic diol having 2 to 12 carbons is more preferable. When the saturated aliphatic diol has a branched-chain structure, crystallinity of the crystalline polyester resin C may be low, which may lower the melting point. When the number of carbon atoms in the saturated aliphatic diol is greater than 12, it may be difficult to yield a material in practice.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin C, and give excellent sharp melt properties.

Examples of the trihydric or more alcohol include glycerin, trimethylol ethane, trimethylolpropane, and pentaerythritol.

These may be used alone or in combination of two or more thereof.

Multivalent Carboxylic Acid

The multivalent carboxylic acid is not particularly limited and may be appropriately selected depending on the intended purpose. Examples thereof include divalent carboxylic acid, and trivalent or more carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (C1-C3) alkyl ester of the foregoing compounds.

Examples of the trivalent or more carboxylic acid include 1,2,4-benzenetricarboxylic acid, 1,2,5-benzenetricarboxylic acid, 1,2,4-naphthalene tricarboxylic acid, anhydrides thereof, and lower (C1-C3) alkyl esters thereof.

Moreover, the multivalent carboxylic acid may contain, other than the saturated aliphatic dicarboxylic acid or aromatic dicarboxylic acid, dicarboxylic acid containing a sulfonic acid group. Further, the multivalent carboxylic acid may contain, other than the saturated aliphatic dicarboxylic acid or aromatic dicarboxylic acid, dicarboxylic acid having a double bond. These may be used alone or in combination of two or more thereof.

The crystalline polyester resin C is preferably composed of a linear chain saturated aliphatic dicarboxylic acid having 4 to 12 carbon atoms and a linear chain saturated aliphatic diol having 2 to 12 carbon atoms. Specifically, the crystalline polyester resin preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improve, and therefore it is preferable as excellent low temperature fixing ability of the toner is exhibited.

A melting point of the crystalline polyester resin is not particularly limited and may be appropriately selected depending on the intended purpose, but it is preferably 60° C. to 80° C. When the melting point thereof is lower than 60° C., the crystalline polyester resin tends to be melted at low temperature, which may impair heat resistant storage stability of the toner. When the melting point thereof is higher than 80° C., melting of the crystalline polyester resin C with heat applied during fixing may be insufficient, which may impair low temperature fixing ability of the toner.

A molecular weight of the crystalline polyester resin C is not particularly limited and may be appropriately selected depending on the intended purpose. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin C preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) there be 2,000 to 10,000, and the Mw/Mn=1.0 to 5.0.

An acid value of the crystalline polyester resin C is not particularly limited and may be appropriately selected depending on the intended purpose, but it is preferably 5 mgKOH/g or higher, more preferably 10 mgKOH/g or higher for achieving the desired low temperature fixing ability in view of affinity between paper and the resin. Meanwhile, the acid value thereof is preferably 45 mgKOH/g or lower for the purpose of improving hot offset resistance.

A hydroxyl value of the crystalline polyester resin C is not particularly limited and may be appropriately selected depending on the intended purpose, but it is preferably 0 mgKOH/g to 50 mgKOH/g, more preferably 5 mgKOH/g to 50 mgKOH/g, for achieving the desired low temperature fixing ability and excellent charging properties.

A molecular structure of the crystalline polyester resin C can be confirmed by solution-state or solid-state NMR, X-ray diffraction, GC/MS, LC/MS, or IR spectroscopy. Simple methods thereof include a method for detecting, as the crystalline polyester resin C, one that has absorption based on δCH (out-of-plane bending vibration) of olefin at 965 $cm^{-1}$±10 $cm^{-1}$ and 990 $cm^{-1}$+10 $cm^{-1}$ in an infrared absorption spectrum.

An amount of the crystalline polyester resin C is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is smaller than 3 parts by mass, the crystalline polyester resin C does not give sufficient sharp melt properties, which may lead to insufficient low temperature fixing ability of a resulting toner. When the amount thereof is greater than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

<Other Components>

Besides the aforementioned components, a release agent, a charge controlling agent, external additive, a flow improving agent, a cleaning improving agent, and a magnetic material can be included in a toner of the present invention, if necessary.

<Release Agent>

The release agent is appropriately selected from those known in the art without any limitation. Examples thereof include a natural wax, a synthetic hydrocarbon wax.

Examples of the natural waxes include: vegetable waxes such as carnauba wax, cotton wax, Japan wax and rice wax; animal waxes such as bees wax and lanolin; mineral waxes such as ozokerite and ceresin; and petroleum waxes such as paraffin, microcrystalline wax and petrolatum. Examples of the synthetic hydrocarbon waxes include Fischer-tropsch wax, polyethylene and polypropylene.

Further, other examples of the release agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, natural waxes are preferable, vegetable waxes are more preferable, and carnauba wax is still more preferable.

<Charge Controlling Agent>

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all products of ORIENT CHEMICAL INDUSTRIES CO., LTD.); quaternary ammonium salt molybdenum complex TP-302 and TP-415 (all products of Hodogaya Chemical Co., Ltd.); LRA-901; boron complex LR-147 (product of Japan Carlit Co., Ltd.); copper phthalocyanine; perylene; quinacridone; azo-pigments; and polymeric compounds having, as a functional group, a sulfonic acid group, carboxyl group, quaternary ammonium salt, etc.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

<External Additive>

As for the external additive, other than oxide particles, a combination of inorganic particles and hydrophobic-treated inorganic particles can be used. The average primary particle diameter of the hydrophobic-treated particles is preferably 1 nm to 100 nm. More preferred are 5 nm to 70 nm of the inorganic particles.

Moreover, it is preferred that the external additive contain at least one type of hydrophobic-treated inorganic particles having the average primary particle diameter of 20 nm or smaller, and at least one type of inorganic particles having the average primary particle diameter of 30 nm or greater. Moreover, the external additive preferably has the BET specific surface area of 20 $m^2/g$ to 500 $m^2/g$.

The amount of the external additive is not particularly limited and may be appropriately selected depending on the intended purpose. The amount thereof is preferably 0.1 parts by mass to 5 parts by mass, more preferably 0.3 parts by mass to 3 parts by mass, relative to 100 parts by mass of the toner.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all products of Nippon Aerosil Co., Ltd.). Examples of the titania particles include P-25 (product of Nippon Aerosil Co., Ltd.); STT-30, STT-65C-S (both product of Titan Kogyo, Ltd.); TAF-140 (product of Fuji Titanium Industry Co., Ltd.); and MT-150W, MT-500B, MT-600B, MT-150A (all products of TAYCA CORPORATION).

Examples of the hydrophobic treated titanium oxide particles include: T-805 (product of Nippon Aerosil Co., Ltd.); STT-30 A, STT-65S-S (both product of Titan Kogyo, Ltd.); TAF-500T, TAF-1500T (both product of Fuji Titanium Industry Co., Ltd.); MT-100S, MT-100 T (both product of TAYCA CORPORATION); and IT-S(product of ISHIHARA SANGYO KAISHA, LTD.).

The hydrophobic-treated oxide particles, hydrophobic-treated silica particles, hydrophobic-treated titania particles, and hydrophobic-treated alumina particles are obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

The average particle diameter of primary particles of the inorganic particles is not particularly limited and may be appropriately selected depending on the intended purpose, but it is preferably 100 nm or smaller, more preferably 3 nm to 70 nm. When it is smaller than 3 nm, the inorganic particles are embedded in the toner particles, and therefore the function of the inorganic particles may not be effectively exhibited. When the average particle diameter thereof is greater than 70 nm, the inorganic particles may unevenly damage a surface of a photoconductor, and hence not preferable.

<Flowability Improving Agent>

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide be used as hydrophobic silica or hydrophobic titanium oxide treated with the aforementioned flow improving agent.

<Cleanability Improving Agent>

The cleanability improving agent is not particularly limited and may be appropriately selected depending on the intended purpose so long as it can be added to the toner for the purpose of removing the developer remained on a photoconductor or primary transfer member after transferring. Examples thereof include: fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

<Magnetic Material>

The magnetic material is not particularly limited and may be appropriately selected depending on the intended purpose. Examples thereof include iron powder, magnetite, and ferrite. Among them, a white magnetic material is preferable in terms of a color tone.

A toner of the present invention is preferably a toner obtained through a step of emulsifying or dispersing a toner material phase in an aqueous medium containing water, where the toner material phase is prepared by dissolving or dispersing a toner material containing a non-crystalline resin and a magenta pigment in an organic solvent.

The volume average particle diameter of the toner of the present invention is not particularly limited and may be appropriately selected depending on the intended purpose.

The volume average particle diameter thereof is preferably 1 μm to 6 μM, more preferably 2 μM to 5 μm. When the volume average particle diameter is less than 1 μM, toner dust particles are likely to generate during primary transfer and secondary transfer time. When the volume average particle diameter is more than 6 μm, dot reproducibility may be insufficient, graininess of the half tone part may deteriorate, which may not obtain a high-resolution image.

<Calculation Methods and Analysis Methods of Various Properties of Toner and Constituent Component of Toner>

Each property of the non-linear, non-crystalline polyester resin A, the non-crystalline polyester resin B, the crystalline polyester resin C, and the release agent may be each measured. Alternatively, each component may be separated from a toner by GPC or the like, and separated each component may be subjected to the analysis methods described later, to thereby measure the properties such as Tg, molecular weight, and melting point, and to thereby calculate mass ratio of a constituent component.

Separation of each component by GPC can be performed, for example, by the following method.

In GPC using THF as a mobile phase, an eluate is subjected to fractionation by a fraction collector, a fraction corresponding to a part of a desired molecular weight is collected from a total area of an elution curve. The collected eluates are concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative or quantitative analysis by high performance liquid chromatography (HPLC).

Note that, in the case where the method for producing a toner produces toner base particles by generating the non-linear, non-crystalline polyester resin A through a chain-elongation reaction and/or crosslink reaction of the non-linear chain reactive precursor and the curing agent, the polyester resin may be separated from an actual toner by GPC or the like, to thereby determine Tg thereof. Alternatively, the non-linear, non-crystalline polyester resin A is separately generated through a chain-elongation reaction and/or crosslink reaction of the non-linear chain reactive precursor and the curing agent, and Tg may be measured on the synthesized non-linear, non-crystalline polyester resin A.

<Separation Unit for Toner Constituent Components, and Measurements of Molecular Weight and Molecular Weight Distribution>

An example of a separation unit for each component during an analysis of the toner will be specifically explained hereinafter.

First, 1 g of a toner is added to 100 mL THF, and the resulting mixture is stirred for 30 minutes at 25° C., to thereby a solution in which soluble components are dissolved. The solution is then filtered through a membrane filter having an opening of 0.2 μm, to thereby obtain the THF soluble components in the toner. Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by a nuclear magnetic resonance apparatus (JNM-AL 400, product of JEOL Ltd.) by performing multiplication 128 times at temperature of 23° C. to 25° C.

The monomer compositions and the compositional ratios of the non liner, non-crystalline polyester resin A, the non-crystalline polyester resin B, and the crystalline polyester resin C in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide (for four hydrogen atoms)

Around 1.6 ppm: derived from a methyl group of bisphenol A and an aliphatic alcohol (for 6 hydrogen atoms).

From these results, for example, the extract collected in a fraction containing the non-linear non-crystalline polyester resin A in an amount of 90% or more can be treated as the non-linear non-crystalline polyester resin A. Similarly, the extract collected in a fraction containing the non-linear non-crystalline polyester resin B and C in an amount of 90% or more can be treated as the non-linear non-crystalline polyester resin B and C, respectively.

<<Measurement Method of Storage Modulus (G')>>

A storage modulus (G') can be measured using a dynamic viscoelasticity measuring device (ARES, product of TA instruments). A frequency is 1 Hz during measurement.

Specifically, the measuring method of storage modulus (G') is described as follows.

A measurement sample is molded into a pellet having a diameter of 8 mm and a thickness of 1 mm to 2 mm. Then, the resultant is fixed on a parallel plate having a diameter of 8 mm, allowed to stabilize at 40° C., and allowed to rise in temperature to 200° C. at frequency: 1 Hz (6.28 rad/s), strain amount: 0.1% (controlled strain mode), and heating rate: 2.0° C./min.

<Measurement Methods of Melting Point and Glass Transition Temperature (Tg)>

In the present invention, a melting point and Tg can be measured, for example, by DSC system (differential scanning calorimeter, Q-200: product of TA Instruments Japan Inc.).

Specifically, a melting point and Tg of a sample are measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by a differential scanning calorimeter (Q-200: product of TA Instruments Japan Inc.).

The DSC curve for the first heating is selected from the obtained DSC curve by an analysis program stored in the Q-200 system, to thereby determine Tg of the sample with the first heating. Similarly, the DSC curve for the second heating is selected, and the Tg of the sample with the second heating can be determined.

Moreover, the DSC curve for the first heating is selected from the obtained DSC curve by the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the present invention, when a toner is used as a target sample, the glass transition temperature of the toner in first heating is defined as Tg1st, and the glass transition temperature of the toner in second heating is defined as Tg2nd.

Also in the present invention, regarding the Tg and the melting point of the non-linear, non-crystalline polyester resin A, the non-crystalline polyester resin B, the crystalline polyester resin C, and the other constituent components such as the release agent, the endothermic peak top temperature and the Tg in the second heating are defined as the melting point and the Tg of each of the target samples, respectively, unless otherwise specified.

<<Measurement Method for Particle Size Distribution>>

The volume average particle diameter (D4), the number average particle diameter (Dn), and the ratio therebetween (D4/Dn) of the toner can be measured using, for example, Coulter Counter TA-II or Coulter Multisizer II (these products are of Coulter, Inc.). In the present invention, Coulter Multisizer II was used. The measurement method is as follows.

First, a surfactant (0.1 mL to 5 mL), preferably a polyoxyethylene alkyl ether (nonionic surfactant), is added as a dispersing agent to an aqueous electrolyte solution (100 mL to 150 mL). Here, the aqueous electrolyte solution is an about 1% by mass aqueous NaCl solution prepared using 1st grade sodium chloride, and ISOTON-II (product of Coulter, Inc.) can be used as the aqueous electrolyte solution. Next, a measurement sample in an amount of 2 mg to 20 mg is added therein. The resultant aqueous electrolyte solution in which the sample has been suspended is dispersed with an ultrasonic wave disperser for about 1 min to about 3 min. The thus-obtained dispersion liquid is analyzed with the above-described apparatus using an aperture of 100 μm to measure the number or volume of the toner particles (or toner). Then, the volume particle size distribution and the number particle size distribution are calculated from the obtained values. From these distributions, the volume average particle diameter (D4) and the number average particle diameter (Dn) of the toner can be obtained.

In this measurement, 13 channels are used: 2.00 μM (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

<<Measurement of Molecular Weight>>

The molecular weight of each of the constituent components of the toner can be measured by the following method, for example.

Gel permeation chromatography (GPC) measuring apparatus: GPC-8220 GPC (product of TOSOH CORPORATION)

Column: TSKgel Super HZM-H 15 cm, 3 columns connected (product of TOSOH CORPORATION)

Temperature: 40° C.

Solvent: THF

Flow rate: 0.35 mL/min

Sample: 0.15% by mass sample (0.4 mL) applied

Pretreatment of sample: The toner is dissolved in THF (containing a stabilizer, product of Wako Pure Chemical Industries, Ltd.) in a concentration of 0.15% by mass, and the solution is filtrated with a 0.2-μm filter. The resultant filtrate is used as a sample. This THF sample solution (100 μL) is applied for measurement.

In the measurement of the molecular weight of the sample, the molecular weight distribution of the sample is determined based on the relationship between the logarithmic value and the count number of a calibration curve given by using several monodisperse polystyrene-standard samples. The standard polystyrene samples used for giving the calibration curve are Showdex STANDARD Std. Nos. S-7300, S-210, S-390, S-875, S-1980, S-10.9, S-629, S-3.0 and S-0.580 (these products are of SHOWA DENKO K.K.). The detector used is a refractive index (RI) detector.

<<Measurement Method for Acid Value>>

The acid value is measured according to the method of JIS K0070-1992.

Specifically, first, 0.5 g of a sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used. Then, a potentiometric automatic titrator DL-53 (product of Mettler-Toledo K.K.) and an electrode DG113-SC (product of Mettler-Toledo K.K.) are used to measure the acid value at 23° C. The measurements are analyzed with analysis software LabX Light Version 1.00.000. The calibration for this apparatus is performed using a solvent mixture of toluene (120 mL) and ethanol (30 mL).

Here, the measurement conditions for the measurement of the acid value are as follows.

| [Measurement conditions] | |
|---|---|
| Stir | |
| Speed[%] 25 | |
| Time[s] 15 | |
| EQP titration | |
| Titrant/Sensor | |
| Titrant $CH_3ONa$ | |
| Concentration [mol/L] 0.1 | |
| Sensor DG115 | |
| Unit of measurement mV | |
| Predispensing to volume | |
| Volume [mL] 1.0 | |
| Wait time [s] 0 | |
| Titrant addition | Dynamic |
| dE(set)[mV] | 8.0 |
| dV(min)[mL] | 0.03 |
| dV(max)[mL] | 0.5 |
| Measure mode | Equilibrium controlled |
| dE[mV] | 0.5 |
| dt[s] | 1.0 |
| t(min)[s] | 2.0 |
| t(max)[s] | 20.0 |
| Recognition | |
| Threshold | 100.0 |
| Steepest jump only | No |
| Range | No |
| Tendency | None |
| Termination | |
| at maximum volume[mL] | 10.0 |
| at potential | No |
| at slope | No |
| after number EQPs | Yes |
| n = 1 | |
| comb. termination conditions | No |
| Evaluation | |
| Procedure | Standard |
| Potential1 | No |
| Potential2 | No |
| Stop for reevaluation | No |

The acid value can be measured in the above-described manner. Specifically, the sample solution is titrated with a pre-standardized 0.1N potassium hydroxide/alcohol solution and then the acid value is calculated from the titer using the equation: acid value (mgKOH/g)=titer (mL)×N×56.1 (mg/mL)/mass of sample (g), where N is a factor of 0.1N potassium hydroxide/alcohol solution.

<Production Method for the Toner>

A production method for the toner is not particularly limited and may be appropriately selected depending on the intended purpose. Preferably, the toner is granulated by dispersing an oil phase in an aqueous medium, the oil phase containing the non-linear, non-crystalline polyester resin A, the non-crystalline polyester resin B, the crystalline polyester resin C, and, if necessary, further containing the release agent, the colorant, etc.

Also, the toner is preferably granulated by dispersing an oil phase in an aqueous medium, the oil phase containing the non-linear, reactive precursor, the non-crystalline polyester resin B, and the crystalline polyester resin C and, if necessary, further containing the curing agent, the release agent, the colorant, etc. One example of such production methods for the toner is a known dissolution suspension method.

As one example of the production methods for the toner, there will be described below a method of forming toner base particles while forming the non-linear, non-crystalline polyester resin A through elongating reaction and/or cross-linking reaction between the non-linear, reactive precursor and the curing agent. This method includes preparing an aqueous medium, preparing an oil phase containing toner materials, emulsifying or dispersing the toner materials, and removing an organic solvent.

—Preparation of Aqueous Medium (Aqueous Phase)—

The preparation of the aqueous phase can be carried out, for example, by dispersing resin particles in an aqueous medium. An amount of the resin particles in the aqueous medium is not particularly limited and may be appropriately selected depending on the intended purpose, but it is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used independently, or in combination. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

<Preparation of Oil Phase>

Preparation of the oil phase containing the toner materials can be performed by dissolving or dispersing toner materials in an organic solvent, the toner materials containing at least the non-linear, reactive precursor, the non-crystalline polyester resin B, the crystalline polyester resin C, and, if necessary, further containing the curing agent, the release agent, the colorant, etc.

The organic solvent is not particularly limited and may be appropriately selected depending on the intended purpose, but it is preferably an organic solvent having a boiling point of lower than 150° C., as removal thereof is easy.

The organic solvent having the boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

—Emulsification or Dispersion—

Emulsification or dispersion of the toner materials can be performed by dispersing, in the aqueous medium, the oil phase containing the toner materials. In emulsifying or dispersing the toner materials, the curing agent and the non-linear, reactive precursor are allowed to undergo elongating reaction and/or cross-linking reaction, whereby the non-linear, non-crystalline polyester resin A is formed.

The non-linear, non-crystalline polyester resin A may be formed by, for example, any of methods (1) to (3) below.

(1) A method including emulsifying or dispersing, in the aqueous medium, the oil phase containing the non-linear, reactive precursor and the curing agent, and allowing, in the aqueous medium, the curing agent and the non-linear, reactive precursor to undergo elongating reaction and/or cross-linking reaction.

(2) A method including emulsifying or dispersing, in the aqueous medium, the oil phase containing the non-linear, reactive precursor which the curing agent has been added in advance, and allowing, in the aqueous medium, the curing agent and the non-linear, reactive precursor to undergo elongating reaction and/or cross-linking reaction.

(3) A method including emulsifying or dispersing, in the aqueous medium, the oil phase containing the non-linear, reactive precursor, adding the curing agent to the resultant aqueous medium, and allowing, in the aqueous medium, the curing agent and the non-linear, reactive precursor to undergo elongating reaction and/or cross-linking reaction from the interfaces of the particles.

Incidentally, in the case where the curing agent and the non-linear, reactive precursor are allowed to undergo elongating reaction and/or cross-linking reaction from the interfaces of the particles, the non-linear, non-crystalline polyester resin A is formed preferentially in the surfaces of the formed toner particles and as a result, a concentration gradient of the non-linear, non-crystalline polyester resin A can be provided in each of the toner particles.

The reaction conditions (e.g., the reaction time and reaction temperature) for generating the non-linear, non-crystalline polyester resin A are not particularly limited and may be appropriately selected depending on a combination of the curing agent and the non-linear, non-linear, reactive precursor.

The reaction time is preferably 10 minutes to 40 hours, more preferably 2 hours to 24 hours.

The reaction temperature is preferably 0° C. to 150° C., more preferably 40° C. to 98° C.

A method for stably forming a dispersion liquid containing the non-linear, reactive precursor in the aqueous medium is not particularly limited and may be appropriately selected depending on the intended purpose. Examples thereof include a method in which an oil phase, which has been prepared by dissolving and/or dispersing a toner material in a solvent, is added to a phase of an aqueous medium, followed by dispersing with shear force.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser. Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, the dispersion time, and the dispersion temperature, may be appropriately selected depending on the intended purpose. The rotating speed is preferably 1,000 rpm to 30,000 rpm, more preferably 5,000 rpm to 20,000 rpm. The dispersion time is preferably 0.1 minutes to 5 minutes in case of a batch system. The dispersion temperature is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material. When the amount of the aqueous medium is smaller than 50 parts by mass, the dispersion state of the toner material is impaired, which may result a failure in attaining toner base particles having desired particle diameters. When the amount thereof is greater than 2,000 parts by mass, the production cost may increase.

When the oil phase containing the toner material is emulsified or dispersed, a dispersant is preferably used for the purpose of stabilizing dispersed elements, such as oil droplets, and gives a shape particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination of two or more thereof. Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

Examples of the anionic surfactant include alkyl benzene sulfonic acid salts, α-olefin sulfonic acid salts and phosphoric acid esters. Among them, those having a fluoroalkyl group are preferable.

In cases where the non-linear, non-crystalline polyester resin A is generated, a catalyst can be used for a chain-elongation reaction and/or crosslink reaction.

The catalyst is not particularly limited and may be appropriately selected depending on the intended purpose. Examples thereof include dibutyltin laurate and dioctyltin laurate.

Removal of Organic Solvent

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive, and the charge controlling agent. By applying a mechanical impact during the mixing, the particles such as the external additive can be prevented from fall off from surfaces of the toner base particles.

A method for applying the mechanical impact is not particularly limited and may be appropriately selected depending on the intended purpose. Examples thereof include: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a carrier containing a core, and a resin layer covering the core.

—Core—

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or higher), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearing member in the form of a brush can be reduced, which is an advantageous for improving image quality.

These may be used alone or in combination of two or more thereof.

The volume average particle diameter of the core is not particularly limited and may be appropriately selected depending on the intended purpose, but it is preferably 10 μm to 150 μm, more preferably 40 μm to 100 μm. When the volume average particle diameter thereof is smaller than 10 the proportion of fine particles in the distribution of carrier particle diameters increases, causing carrier scattering because of low magnetization per carrier particle. When the volume average particle diameter thereof is greater than 150 the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 parts by mass to 98 parts by mass, more preferably 93 parts by mass to 97 parts by mass, relative to 100 parts by mass of the two-component developer.

The developer of the present invention may be suitably used in image formation by various known electrophotographies such as a magnetic one-component developing method, a non-magnetic one-component developing method, and a two-component developing method.

<Image Forming Apparatus>

An image forming apparatus of the present invention includes an electrostatic latent image bearer, an electrostatic latent image forming unit configured to form an electrostatic latent image on the electrostatic latent image bearer, and a developing unit containing a toner and configured to develop the electrostatic latent image on the electrostatic latent image bearer to form a visible image, wherein the toner is the toner according to any one of the above 1) to 7).

The developing unit is a unit configured to develop the electrostatic latent image with the toner of the present invention to form a visible image.

Figure 2:
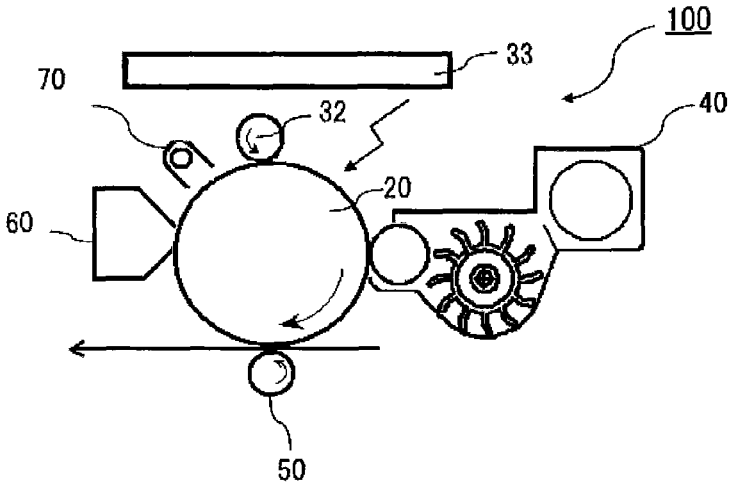
FIG. 2 is a schematic view of one example of a two-component developing device.

FIG. 2 is a schematic view of one example of a two-component developing device using a two-component developer containing the toner of the present invention and a carrier. An arrow indicates laser light. In this image forming apparatus (100), first, an electrostatic latent image bearer (20) is rotationally driven at a predetermined circumferential speed, and the circumferential surface of the electrostatic latent image bearer (20) is uniformly charged positively or negatively by a charging device (32) to have a predetermined potential. Next, the circumferential surface of the electrostatic latent image bearer (20) is exposed to light by an exposing device (33), so that electrostatic latent images are formed sequentially. Thus, the electrostatic latent image forming unit of this image forming apparatus includes the charging device (32) and the exposing device (33). Furthermore, the electrostatic latent images formed on the circumferential surface of the electrostatic latent image bearer (20) are developed by a developing device (40) using a developer containing the toner of the present invention and a carrier, whereby toner images are formed. Next, the toner images formed on the circumferential surface of the electrostatic latent image bearer (20) are sequentially transferred onto transfer paper sheets which have been synchronized with the rotation of the electrostatic latent image bearer (20) and fed from a paper feeding portion to between the electrostatic latent image bearer (20) and a transfer device (50). Moreover, the transfer paper sheets onto which the toner images have been transferred are separated from the circumferential surface of the electrostatic latent image bearer (20) and introduced to a fixing device where the toner images are fixed on the transfer paper sheets, and then printed out to the outside of the image forming apparatus as copy products (copies). In the meantime, the surface of the electrostatic latent image bearer (20) from which the toner images have been transferred is cleaned by a cleaning device (60) such that the residual toner is removed. Thereafter, the surface of the electrostatic latent image bearer (20) is charge-eliminated by a charge-eliminating device (70) and is used for image formation repeatedly.

EXAMPLES

The present invention will be described in more detail by way of Examples and Comparative Examples. The present invention is, however, not construed as being limited to these Examples. Note that, "part(s)" and "%" mean "part(s) by mass" and "% by mass", respectively, unless otherwise specified.

<Preparation of a Pigment>

(1) Production of Pigment Red 184 (Pigment J1) having specific spectrum

3-Amino-4-methoxybenzanilide (84 parts) was dispersed in water (1,500 parts), and ice was added thereto to adjust the temperature conditions to be 0° C. or lower. Then, a 35% aqueous hydrochloric acid solution (125 parts) was added to the mixture, followed by stirring for 1 hour, to thereby be formed into a hydrochloride. Next, a 40% aqueous sodium nitrite solution (61.5 parts) was added to the mixture, which was then stirred for 1 hour. Thereafter, sulfamic acid (4 parts) was added to the mixture to decompose extra nitrous acid, to thereby prepare an aqueous diazonium solution.

Meanwhile, a wet cake (58.2 parts in a dried state) of N-(2'-methyl-5'-chlorophenyl)-3-hydroxy-2-naphthalenecarboxyamide alkaline compound, serving as coupling component-1, and a wet cake (66.4 parts in a dried state) of N-(2',5'-dimethoxy-4'-chlorophenyl)-3-hydroxy-2-naphthalene carboxyamide alkaline compound, serving as coupling component-2, were dispersed in water (1,000 parts). Sodium dodecyl sulfonate (1 part) serving as a particle controlling agent for pigment particles was added to the mixture, and water was added thereto to adjust the temperature to 20° C., whereby a coupler solution was prepared.

While this coupler solution was being kept at 20° C., the above-prepared aqueous diazonium solution was gradually added dropwise thereto. Coupling reaction was allowed to take place while the pH of the liquid was being kept at a pH of 11.5±0.5, followed by stirring for 1 hour to complete the reaction.

After 1 hour, disappearance of the diazonium was confirmed by high-performance liquid chromatography, and an appropriate amount of a 35% aqueous hydrochloric acid solution was added to the reaction mixture to adjust the pH thereof to 7.0 to 7.5. The obtained slurry was thermally treated by being stirred for 1 hour at 100° C., followed by filtration, washing with water, drying at 90° C. to 100° C., and pulverizing, to thereby obtain a naphthol pigment; i.e., Pigment Red 184 (Pigment J1) having a specific spectrum.

Tables 1 and 2 show the amount of sodium dodecyl sulfonate, the pH of the coupling reaction liquid, the conditions for thermal treatment, and the half value width in the X-ray diffraction in Pigment J1.

TABLE 1

| Pigment | Sodium dodecyl sulfonate (parts by mass) | pH of coupling reaction liquid | Conditions for thermal treatment |
|---|---|---|---|
| Pigment J1 | 10 | 11.0 ± 0.5 | 100° C., 1 hour |

TABLE 2

| Peak No. | 2θ (°) | Half value width (°) Pigment J1 |
|---|---|---|
| Peak 1 | 5.3 | 1.4 |
| Peak 2 | 13.1 | 1.2 |
| Peak 3 | 17.9 | 1.1 |
| Peak 4 | 20.5 | 2.0 |
| Peak 5 | 26.8 | 1.4 |
| Total | | 7.1 |

(2) Production of Pigment Red 269 (Pigment K1) having specific spectrum

A naphthol pigment; i.e., Pigment Red 269 (Pigment K1) having a specific spectrum was produced in the same manner as in the production of Pigment J1 except that the coupling component-1 and the coupling component-2 were changed to a wet cake (124.5 parts in a dried state) of N-(2'-methoxy-5'-chlorophenyl)-3-hydroxy-2-naphthalene carboxyamide alkaline compound, serving as coupling component-3.

In addition, Pigments K2 to K5 were produced by changing the synthesis conditions for the production of Pigment K1 to those described in the following Table 3.

Tables 3 and 4 show the amounts of sodium dodecyl sulfonate, the pH of the coupling reaction liquids, the conditions for thermal treatments, and the half value widths in the X-ray diffraction in Pigments K1 to K5.

TABLE 3

| Pigment | Sodium dodecyl sulfonate (parts by mass) | pH of coupling reaction liquid | Conditions for thermal treatment |
|---|---|---|---|
| Pigment K1 | 1 | 9.5 ± 0.5 | 60° C., 1 hour |
| Pigment K2 | 5 | 10.0 ± 0.5 | 80° C., 1 hour |
| Pigment K3 | 10 | 11.0 ± 0.5 | 100° C., 1 hour |
| Pigment K4 | 10 | 11.0 ± 0.5 | 110° C., 3 hours |
| Pigment K5 | 15 | 12.0 ± 0.5 | 120° C., 3 hours |

TABLE 4

| Peak No. | 2θ (°) | Half value width (°) Pigment K1 | Pigment K2 | Pigment K3 | Pigment K4 | Pigment K5 |
|---|---|---|---|---|---|---|
| Peak 1 | 5.5 | 1.4 | 1.3 | 0.9 | 0.7 | 0.6 |
| Peak 2 | 12.8 | 1.5 | 1.4 | 1.0 | 0.8 | 0.7 |
| Peak 3 | 17.9 | 2.0 | 1.9 | 1.4 | 1.0 | 0.9 |
| Peak 4 | 20.3 | 3.2 | 3.0 | 2.2 | 1.7 | 1.5 |
| Peak 5 | 23.0 | 0.5 | 0.5 | 0.3 | 0.3 | 0.2 |
| Peak 6 | 27.0 | 1.7 | 1.6 | 1.1 | 0.9 | 0.8 |
| Total | | 10.3 | 9.7 | 6.9 | 5.4 | 4.7 |

—Synthesis of Ketimine—

A reaction container equipped with a stirring rod and a thermometer was charged with isophoronediamine(170 parts) and methyl ethyl ketone (75 parts), followed by reaction at 50° C. for 5 hours, to thereby obtain [ketimine compound 1]. The amine value of the obtained [ketimine compound 1] was found to be 418.

<Synthesis of Non-Linear, Non-Crystalline Polyester Resin A1>

—Synthesis of Prepolymer A1—

A reaction vessel equipped with a condenser, a stirring device, and a nitrogen-introducing tube was charged with 3-methyl-1,5-pentanediol, isophthalic acid, and adipic acid so that a ratio by mole of hydroxyl group to carboxyl group "OH/COOH" was 1.1. A ratio by mole between isophthalic acid and adipic acid was set to 90/10. Moreover, trimethylolpropane was added together with titanium tetraisopropoxide (1,000 μm relative to the resin component) so that an amount of the trimethylolpropane was 1.5% by mole relative to the total amount of the monomers. Thereafter, the resultant mixture was heated to 200° C. for about 4 hours and then heated to 230° C. for 2 hours, and was allowed to react until no flowing water was formed. Thereafter, the reaction mixture was allowed to further react for 5 hours under a reduced pressure of 10 mmHg to 15 mmHg for 5 hours, to thereby produce intermediate polyester A1.

Next, a reaction vessel equipped with a condenser, a stirring device, and a nitrogen-introducing tube was charged with the intermediate polyester A1 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A1.

—Synthesis of Non-Linear, Non-Crystalline Polyester Resin A1—

The obtained prepolymer A1 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A1. The reaction mixture was stirred at 45° C. for 10 hours, and then the polymer product extended was taken out. The obtained polymer product extended was dried at 50° C. under reduced pressure until the amount of the remaining ethyl acetate was 100 ppm or less, to thereby obtain non-linear, non-crystalline polyester resin A1.

<Synthesis of Non-Linear, Non-Crystalline Polyester Resin A2>

—Synthesis of prepolymer A2—

A reaction vessel equipped with a condenser, a stirring device, and a nitrogen-introducing tube was charged with bisphenol A ethylene oxide 2 mole adduct, bisphenol A propylene oxide 2 mole adduct, terephthalic acid, and trimelltic anhydride so that a ratio by mole of hydroxyl group to carboxyl group "OH/COOH" was 1.3. A ratio by mole between bisphenol A ethylene oxide 2 mole adduct and bisphenol A propylene oxide 2 mole adduct was set to 90/10, and a ratio by mole between terephthalic acid and trimelltic anhydride was set to 90/10. Moreover, titanium tetraisopropoxide (1,000 ppm relative to the resin component) was added thereto. The resultant mixture was heated to 200° C. for about 4 hours and then heated to 230° C. for 2 hours, and was allowed to react until no flowing water was formed. Thereafter, the reaction mixture was allowed to further react for 5 hours under a reduced pressure of 10 mmHg to 15 mmHg for 5 hours, to thereby produce intermediate polyester A2.

Next, a reaction vessel equipped with a condenser, a stirring device, and a nitrogen-introducing tube was charged with the intermediate polyester A2 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A2.

—Synthesis of Non-Linear, Non-Crystalline Polyester Resin A2—

The obtained prepolymer A2 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A2. The reaction mixture was stirred at 45° C. for 10 hours, and then the polymer product extended was taken out. The obtained polymer product extended was dried at 50° C. under reduced pressure until the amount of the remaining ethyl acetate was 100 ppm or less, to thereby obtain non-linear, non-crystalline polyester resin A2.

<Synthesis of non-linear, non-crystalline polyester resin A3>

—Synthesis of prepolymer A3—

A reaction vessel equipped with a condenser, a stirring device, and a nitrogen-introducing tube was charged with bisphenol A ethylene oxide 2 mole adduct, bisphenol A propylene oxide 2 mole adduct, terephthalic acid, and trimelltic anhydride so that a ratio by mole of hydroxyl group to carboxyl group "OH/COOH" was 1.3. A ratio by mole between bisphenol A ethylene oxide 2 mole adduct and bisphenol A propylene oxide 2 mole adduct was set to 90/10, and a ratio by mole between terephthalic acid and trimelltic anhydride was set to 90/10. Moreover, titanium tetraisopropoxide (1,000 ppm relative to the resin component) was added thereto. The resultant mixture was heated to 200° C. for about 4 hours and then heated to 230° C. for 2 hours, and was allowed to react until no flowing water was formed. Thereafter, the reaction mixture was allowed to further react for 5 hours under a reduced pressure of 10 mmHg to 15 mmHg, to thereby produce intermediate polyester A3.

Next, a reaction vessel equipped with a condenser, a stirring device, and a nitrogen-introducing tube was charged with the intermediate polyester A3 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A3.

—Synthesis of non-linear, non-crystalline polyester resin A3—

The obtained prepolymer A3 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A3. The reaction mixture was stirred at 45° C. for 10 hours, and then the polymer product extended was taken out. The obtained polymer product extended was dried at 50° C. under reduced pressure until the amount of the remaining ethyl acetate was 100 ppm or less, to thereby obtain non-linear, non-crystalline polyester resin A3. This resin was found to have a weight average molecular weight (Mw) of 130,000 and a Tg of 54° C.

<Synthesis of non-linear, non-crystalline polyester resin A4>

—Synthesis of prepolymer A4—

A reaction vessel equipped with a condenser, a stirring device, and a nitrogen-introducing tube was charged with 3-methyl-1,5-pentanediol, isophthalic acid, adipic acid, and trimellitic anhydride so that a ratio by mole of hydroxyl group to carboxyl group "OH/COOH" was 1.5. A ratio by mole between isophthalic acid and adipic acid was set to 40/60. Moreover, trimellitic anhydride was added together with titanium tetraisopropoxide (1,000 ppm relative to the resin component) so that an amount of the trimethylolpropane was 1% by mole relative to the total amount of the monomers. Thereafter, the resultant mixture was heated to 200° C. for about 4 hours and then heated to 230° C. for 2 hours, and was allowed to react until no flowing water was formed. Thereafter, the reaction mixture was allowed to further react for 5 hours under a reduced pressure of 10 mmHg to 15 mmHg for 5 hours, to thereby produce intermediate polyester A4.

Next, a reaction vessel equipped with a condenser, a stirring device, and a nitrogen-introducing tube was charged with the intermediate polyester A4 and isophorone diisocyanate at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A4.

—Synthesis of non-linear, non-crystalline polyester resin A4—

The obtained prepolymer A4 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A4. The reaction mixture was stirred at 45° C. for 10 hours, and then the polymer product extended was taken out. The obtained polymer product extended was dried at 50° C. under reduced pressure until the amount of the remaining ethyl acetate was 100 ppm or less, to thereby obtain non-linear, non-crystalline polyester resin A4. This resin was found to have a weight average molecular weight (Mw) of 150,000 and a Tg of −35° C.

<Synthesis of Non-Crystalline Polyester Resin B1>

A four-necked flask equipped with a nitrogen-introducing tube, a dehydration tube, a stirring device, and a thermocouple was charged with bisphenol A ethylene oxide 2 mole adduct, bisphenol A propylene oxide 2 mole adduct, terephthalic acid, and adipic acid so that a ratio by mole of hydroxyl group to carboxyl group "OH/COOH" was 1.3. A ratio by mole between bisphenol A ethylene oxide 2 mole adduct and bisphenol A propylene oxide 2 mole adduct was set to 60/40, and a ratio by mole between terephthalic acid and adipic acid was set to 97/3. Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain amorphous polyester resin B1.

<Synthesis of Non-Crystalline Polyester Resin B2>

A four-necked flask equipped with a nitrogen-introducing tube, a dehydration tube, a stirring device, and a thermocouple was charged with bisphenol A propylene oxide 2 mole adduct, 1,3-propylene glycol, terephthalic acid, and adipic acid so that a ratio by mole of hydroxyl group to carboxyl group "OH/COOH" was 1.4. A ratio by mole between bisphenol A propylene oxide 2 mole adduct and 1,3-propylene glycol was set to 90/10, and a ratio by mole between terephthalic acid and adipic acid was set to 80/20. Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B2.

<Synthesis of Non-Crystalline Polyester Resin B3>

A four-necked flask equipped with a nitrogen-introducing tube, a dehydration tube, a stirring device, and a thermocouple was charged with bisphenol A ethylene oxide 2 mole adduct, bisphenol A propylene oxide 2 mole adduct, isophthalic acid, and adipic acid so that a ratio by mole of hydroxyl group to carboxyl group "OH/COOH" was 1.2. A ratio by mole between bisphenol A ethylene oxide 2 mole adduct and bisphenol A propylene oxide 2 mole adduct was set to 80/20, and a ratio between isophthalic acid and adipic acid was set to 80/20. Moreover, titanium tetraisopropoxide (1,000 ppm relative to the resin component) was added thereto, and the resultant mixture was allowed to react under normal pressure at 230° C. for 10 hours and then to further react under a reduced pressure of 10 mmHg to 15 mmHg for 5 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B3.

<Synthesis of Non-Crystalline Polyester Resin B4>

A four-necked flask equipped with a nitrogen-introducing tube, a dehydration tube, a stirring device, and a thermocouple was charged with bisphenol A ethylene oxide 2 mole adduct, bisphenol A propylene oxide 3 mole adduct, isophthalic acid, adipic acid so that a ratio by mole of hydroxyl group to carboxyl group "OH/COOH" was 1.3. A ratio by mole between bisphenol A ethylene oxide 2 mole adduct and bisphenol A propylene oxide 3 mole adduct was set to 85/15, and a ratio by mole between isophthalic acid and adipic acid was set to 80/20. Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B4. This resin was found to have a weight average molecular weight (Mw) of 5,000 and a Tg of 48° C.

<Synthesis of Crystalline Polyester Resin C>

A four-necked flask of 5 L equipped with a nitrogen-introducing tube, a dehydration tube, a stirring device, and a thermocouple was charged with sebacic acid and 1,6-hexanediol so that a ratio by mole of hydroxyl group to carboxyl group "OH/COOH" was 0.9. Moreover, titanium tetraisopropoxide (500 ppm relative to the resin component) was added thereto, and the resultant mixture was allowed to react under normal pressure at 180° C. for 10 hours, heated to 200° C., allowed to react 3 hours, and then to react under a pressure of 8.3 kPa for 2 hours to thereby obtain a crystalline polyester resin C. This resin was found to have a weight average molecular weight (Mw) of 25,000 and a melting point of 67° C.

<Preparation of Master Batch MBJ1>

Using a Henschel mixer (product of NIPPON COKE & ENGINEERING CO., LTD.), 500 parts of water, 400 parts of pigment J1,600 parts of non-crystalline polyester resin B1, and 12 parts of carnauba wax (trade name: WA-05, product of TOA KASEI CO., LTD.) were mixed. Next, the resulting mixture was kneaded by a twin roll at 150° C. for 30 minutes. The resulting kneaded product was rolled out and cooled, followed by pulverizing by a pulverizer (product of Hosokawa Micron Corporation), to thereby obtain a master batch MBJ1.

<Preparation of Master Batches MBK1 to MBK5>

Master batches MBK1 to MBK5 were prepared in the same manner as in preparation of master batch MBJ1 except that pigment J1 was changed to each of pigments K1 to K5.

Example 1

Production of Wax Dispersion Liquid 1

A vessel to which a stirring bar and a thermometer had been set was charged with 50 parts of paraffin wax (HNP-9, product of Nippon Seiro Co., Ltd., hydrocarbon wax, melting point: 75° C., SP value: 8.8) as a release agent 1, and 450 parts of ethyl acetate, followed by heating to 80° C. with stirring. The temperature was maintained at 80° C. for 5 hours, followed by cooling to 30° C. over 1 hour. The resulting mixture was dispersed by a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain [WAX dispersion liquid 1].

<Production of Crystalline Polyester Resin Dispersion Liquid 1>

A vessel to which a stirring bar and a thermometer had been set was charged with 50 parts of the crystalline polyester resin C, 450 parts of ethyl acetate, followed by heating to 80° C. with stirring. The temperature was maintained at 80° C. for 5 hours, followed by cooling to 30° C. over 1 hour. The resulting mixture was dispersed by a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain [crystalline polyester resin dispersion liquid 1].

<Preparation of Oil Phase 1>

A vessel was charged with 500 parts of the [WAX dispersion liquid 1], 300 parts of the [non-liner, non-crystalline polyester resin A1], 500 parts of the [crystalline polyester resin dispersion liquid 1], 700 parts of the [non-crystalline polyester resin B1], 278 parts of the master batch [MBK3], and 2 parts of the [ketimine compound 1], followed by mixing using a TK Homomixer (product of PRIMIX Corporation) at 5,000 rpm for 60 minutes, to thereby obtain [oil phase 1].

<Synthesis of Particle Dispersion Liquid 1 (Organic Particle Emulsion)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resulting mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid 1].

The [particle dispersion liquid 1] was measured by LA-920 (product of HORIBA, Ltd.), and as a result, the volume average particle diameter thereof was found to be 0.14 μm. Part of the [particle dispersion liquid 1] was dried, and a resin component thereof was isolated.

<Preparation of Aqueous Phase 1>

Water (990 parts), 83 parts of the [particle dispersion liquid 1], 37 parts of a 48.5% aqueous solution of sodium dodecyldiphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Emulsification and Removal of Solvent>

To a container charged with 600 parts of the [oil phase 1], 1,200 parts of the [aqueous phase 1] was added, and the resulting mixture was mixed by a TK Homomixer at 13,000 rpm for 20 minutes, to thereby obtain [emulsified slurry 1].

A container equipped with a stirrer and a thermometer was charged with the [emulsified slurry 1], followed by removing the solvent therein at 30° C. for 8 hours. Thereafter, the resultant was matured at 45° C. for 4 hours, to thereby obtain [dispersion slurry 1].

<Washing and Drying>

After subjecting 100 parts of the [dispersion slurry 1] to filtration under the reduced pressure, the obtained cake was subjected twice to a series of treatments (1) to (4) described below, to thereby produce [filtration cake 1]:

(1): ion-exchanged water (100 parts) was added to the filtration cake, followed by mixing with TK Homomixer (at 12,000 rpm for 10 minutes) and then filtration;

(2): 10% aqueous sodium hydroxide solution (100 parts) was added to the filtration cake obtained in (1), followed by mixing with TK Homomixer (at 12,000 rpm for 30 minutes) and then filtration under reduced pressure;

(3): 10% by mass hydrochloric acid (100 parts) was added to the filtration cake obtained in (2), followed by mixing with TK Homomixer (at 12,000 rpm for 10 minutes) and then filtration; and (4): ion-exchanged water (300 parts) was added to the filtration cake obtained in (3), followed by mixing with TK Homomixer (at 12,000 rpm for 10 minutes) and then filtration.

Next, the [filtration cake 1] was dried with an air-circulating drier at 45° C. for 48 hours, and then was caused to pass through a sieve with a mesh size of 75 μm, to thereby obtain [toner base 1].

<Treatment with External Additives>

The obtained toner base particles 1 (100 parts), hydrophobic silica having an average particle diameter of 100 nm (0.6 parts), titanium oxide having an average particle diameter of 20 nm (1.0 part), and hydrophobic silica fine powder having an average particle diameter of 15 nm (0.8 parts) were mixed together in a Henschel mixer to thereby obtain [toner 1].

A component ratio, Tg1st, and Tg2nd of the obtained [toner 1] are shown in Table 5.

Examples 2 to 10 and Comparative Examples 1 to 5

[Toner 2] to [toner 15] were obtained in the same manner as in the preparation of oil phase 1 of Example 1 except that the kinds and the amounts of the non-liner non-crystalline polyester resin A1 and the non-crystalline polyester resin B1, and the amount of the crystalline polyester resin C were changed to each of the columns of Examples 2 to 10 and Comparative Example 1 to 5 shown in Table 5.

TABLE 5

| | Non-liner, non-crystalline polyester resin A | | Non-crystalline polyester resin B | | Crystalline polyester resin C | Master batch | |
|---|---|---|---|---|---|---|---|
| | Kinds | Parts by mass | Kinds | Parts by mass | Parts by mass | Kinds | Parts by mass |
| Example 1 | A1 | 300 | B1 | 700 | 500 | MBK3 | 278 |
| Example 2 | A1 | 240 | B1 | 760 | 500 | MBK3 | 278 |
| Example 3 | A2 | 300 | B3 | 700 | 500 | MBK3 | 278 |
| Example 4 | A1 | 360 | B3 | 700 | 200 | MBK3 | 278 |
| Example 5 | A2 | 360 | B3 | 640 | 500 | MBK3 | 278 |
| Example 6 | A1 | 300 | B1 | 700 | 500 | MBJ1 | 278 |
| Example 7 | A1 | 300 | B1 | 700 | 500 | MBK4 | 278 |
| Example 8 | A1 | 300 | B1 | 700 | 500 | MBK2 | 278 |
| Example 9 | A5 | 300 | B1 | 700 | 500 | MBK3 | 278 |
| Example 10 | A3 | 300 | B1 | 700 | 500 | MBK3 | 278 |
| Comparative Example 1 | A2 | 300 | B2 | 700 | 500 | MBK3 | 278 |
| Comparative Example 2 | A2 | 300 | B2 | 700 | 500 | MBK5 | 278 |
| Comparative Example 3 | A1 | 300 | B1 | 700 | 500 | MBK1 | 278 |
| Comparative Example 4 | A1 | 300 | B1 | 700 | 500 | MBK5 | 278 |
| Comparative Example 5 | A4 | 300 | B4 | 700 | 500 | MBK3 | 278 |

[G'(100)(THF insoluble matter)], [[G'(40)(THF insoluble matter)]/[G(100)(THF insoluble matter)]], [Tg 1st (toner)], [Tg 2nd(toner)], localized states, the total of the half value widths, and the number of the pigments are shown in Table 6.

TABLE 6

| | G' (100) THF insoluble matter (Pa) | G' (40)/ G' (100) THF insoluble matter | The total of the half value widths (°) | Localized states (% by mass) | Tg 1st (° C.) | Tg 2st (° C.) |
|---|---|---|---|---|---|---|
| Example 1 | $5.0 \times 10^5$ | $3.1 \times 10$ | 6.9 | 40 | 43 | 22 |
| Example 2 | $3.2 \times 10^6$ | $3.5 \times 10$ | 6.9 | 44 | 45 | 25 |
| Example 3 | $3.9 \times 10^5$ | $2.0 \times 10$ | 6.9 | 42 | 35 | 2 |
| Example 4 | $7.0 \times 10^6$ | $3.3 \times 10$ | 6.9 | 41 | 42 | 30 |
| Example 5 | $2.8 \times 10^5$ | $2.6 \times 10$ | 6.9 | 35 | 40 | 18 |
| Example 6 | $4.9 \times 10^5$ | $3.1 \times 10$ | 7.1 | 49 | 43 | 25 |
| Example 7 | $4.8 \times 10^5$ | $3.0 \times 10$ | 5.4 | 40 | 42 | 21 |
| Example 8 | $5.2 \times 10^5$ | $3.1 \times 10$ | 9.7 | 41 | 42 | 24 |
| Example 9 | $6.0 \times 10^6$ | $3.3 \times 10$ | 6.9 | 42 | 25 | 15 |
| Example 10 | $5.2 \times 10^6$ | $3.2 \times 10$ | 6.9 | 42 | 50 | 38 |
| Comparative Example 1 | $8.0 \times 10^4$ | $1.5 \times 10^2$ | 6.9 | 40 | 53 | 31 |
| Comparative Example 2 | $7.6 \times 10^4$ | $1.3 \times 10^2$ | 6.9 | 80 | 49 | 34 |
| Comparative Example 3 | $4.8 \times 10^5$ | $3.1 \times 10$ | 10.3 | 44 | 43 | 22 |
| Comparative Example 4 | $4.9 \times 10^5$ | $3.2 \times 10$ | 4.7 | 45 | 43 | 21 |
| Comparative Example 5 | $7.5 \times 10^7$ | $6.0 \times 10$ | 6.7 | 39 | 30 | 15 |

Each of the obtained toners of Examples and Comparative Examples described above was used to prepare a developer as follows, and each of the properties was evaluated. Results are shown in Table 7.

<<Production of Developer>>

—Production of carrier—

To 100 parts of toluene, 100 parts of silicone resin, 5 parts of γ-(2-aminoethyl)aminopropyltrimethoxy silane, and 10 parts of carbon black were added, and then, the resultant mixture was dispersed by a homomixer for 20 minutes, to thereby prepare a resin layer coating liquid. To surfaces of spherical magnetite particles having the average particle diameter of 50 μm (1,000 parts by mass), the resin layer coating liquid was applied by a fluidized bed coating device, to thereby prepare a carrier.

—Production of developer—

Using a ball mill, each (5 parts) of the toner and the carrier (95 parts) were mixed to thereby produce a developer.

<Color Reproducibility>

Each of the developer was used to output an image in a total area of a coated paper having a size of A4 using a full color multifunction peripheral (IMAGIO NEO C600PRO, product of Ricoh Company, Ltd.), so that the toner was deposited in an amount of 0.30 mg/cm$^2$ in a single magenta color while adjusting image density. Color evaluation was conducted at 9 positions on the paper (i.e., upper-left position, upper-middle position, upper-right position, middle-left position, center position, middle-right position, bottom-left position, bottom-middle position, and bottom-right position) and an average was calculated for these positions. The amount of the toner deposited was calculated based on a change in mass between an output unfixed image on the paper and the output unfixed image after the toner had been removed from the paper through blowing by a compressed air.

(Coated Paper)

POD GLOSS COAT (product of OJI PAPER CO., LTD.)

Basis weight: 158 g/m$^2$

Paper thickness: 175 μm

Brightness: 80% or more

Size: A4

Using a colorimetric device (X-RITE938, product of Xrite), a* and b* were measured under the following measurement conditions based on the following criteria.

(Measurement Conditions)

Light source: D50

Measurement light: 0° light receiving angle, 45° light irradiating angle

Measurement color: 2° field of view

Measurement performed with 10 sheets of gloss paper stacked

[Evaluation Criteria]

A: When a* is 70 or greater but less than 75, b* is −7 or grater but less than −5, and when a* is 75 or greater but less than 80, b* is −5 or greater but less than −3.

B: When a* is 70 or greater but less than 75, b* is −5 or grater but less than −3, and when a* is 75 or greater but less than 80, b* is −3 or greater but less than −1.

C: When a* is 70 or greater but less than 75, b* is −3 or grater but less than −1, and when a* is 75 or greater but less than 80, b* is −1 or greater but less than +1.

D: Other than the above.

<Heat Resistant Storage Stability>

Each of the toners was charged into a 50 mL-glass container, which was then left to stand in a thermostat bath of 50° C. for 24 hours, followed by cooling to 24° C. The thus-treated toner was measured for penetration degree [mm] according to the penetration test (JIS K2235-1991) and evaluated for heat resistant storage stability according to the following criteria.

[Evaluation Criteria]

A: The penetration degree was 20 mm or greater.

B: The penetration degree was 15 mm or greater but less than 20 mm.

C: The penetration degree was 10 mm or greater but less than 15 mm.

D: The penetration degree was less than 10 mm.

<Low Temperature Fixing Ability>

A carrier and each of the toner used in IMAGIO MP C4300 (product of Ricoh Company, Ltd.) was mixed so that each of the toner concentration was 5%, to thereby obtain each developer.

Each of the developers was charged into a unit of IMAGIO MP C4300 (product of Ricoh Company, Ltd.) and a rectangular solid image of 2 cm×15 cm was formed on PPC paper sheets (Type 6000<70W> A4 long grain (product of Ricoh Company, Ltd.) so that the toner was deposited in an amount of 0.40 mg/cm$^2$.

In the formation of the images, the surface temperature of the fixing roller was allowed to change, and whether offset, in which an image remaining after development of the solid image is fixed in other places than the intended places, occurred was visually observed to evaluate low temperature fixing ability at a temperature in which offset does not occur, based on the following criteria.

[Evaluation Criteria]

A: less than 110° C.

B: 110° C. or greater but less than 120° C.

C: 120° C. or greater but less than 130° C.

D: 130° C. or more

TABLE 7

| | Color reproducibility | Heat resistant storage | Low temperature fixing ability |
|---|---|---|---|
| Example 1 | A | A | A |
| Example 2 | B | A | C |
| Example 3 | B | C | A |
| Example 4 | B | A | C |
| Example 5 | A | C | A |

TABLE 7-continued

| | Color reproducibility | Heat resistant storage | Low temperature fixing ability |
|---|---|---|---|
| Example 6 | C | A | B |
| Example 7 | C | A | B |
| Example 8 | C | A | B |
| Example 9 | B | C | A |
| Example 10 | B | A | C |
| Comparative Example 1 | B | A | D |
| Comparative Example 2 | D | A | D |
| Comparative Example 3 | D | A | B |
| Comparative Example 4 | D | A | B |
| Comparative Example 5 | B | A | D |

This application claims priority to Japanese application No.

2014-041532, filed on Mar. 4, 2014 and incorporated herein by reference.

What is claimed is:

1. A magenta toner for electrophotography, comprising:

a polyester resin; and a colorant containing a naphthol-based pigment, wherein the magenta toner for electrophotography satisfies requirements <1> and <2> below:

<1> [G'(100) (THF insoluble matter)] is $1.0\times10^5$ Pa to $1.0\times10^7$ Pa, and a ratio of [G'(40) (THF insoluble matter)] to the [G'(100) (THF insoluble matter)] is 3.5×10 or less, where the [G'(100) (THF insoluble matter)] is a storage modulus at 100° C. of THF insoluble matter of the toner and the [G'(40) (THF insoluble matter)] is a storage modulus at 40° C. of the THF insoluble matter of the toner; and <2> an X-ray diffraction pattern of the naphthol-based pigment in a crystalline state has a plurality of peaks in a range of $0°\leq2\theta\leq35°$, and a sum of half value widths of the peaks is 5° to 10°.

2. The magenta toner according to claim 1, wherein 50% by mass or less of the naphthol-based pigment is present within a region of 1,000 nm from a surface of the toner toward a center thereof.

3. The magenta toner according to claim 1, wherein the magenta toner has a glass transition temperature (Tg1st) of 20° C. to 50° C., where the glass transition temperature (Tg1st) is measured in first heating of differential scanning calorimetry (DSC).

4. The magenta toner according to claim 1, wherein the magenta toner has a glass transition temperature (Tg2nd) of 0° C. to 30° C., where the glass transition temperature (Tg2nd) is measured in second heating of differential scanning calorimetry (DSC).

5. The magenta toner according to claim 1, wherein the polyester resin contains a non-crystalline polyester resin insoluble in THF and a polyester resin soluble in THF.

6. The magenta toner according to claim 5, wherein the non-crystalline polyester resin insoluble in THF has a Tg of 20° C. or lower.

7. The magenta toner according to claim 5, wherein the polyester resin further comprises a crystalline polyester resin.

8. A developer, comprising:

the magenta toner according to claim 1; and a carrier.

9. An image forming apparatus, comprising:

an electrostatic latent image bearer;

an electrostatic latent image forming unit configured to form an electrostatic latent image on the electrostatic latent image bearer; and a developing unit configured to develop the electrostatic latent image formed on the electrostatic latent image bearer with a toner to form a visible image, wherein the toner is the magenta toner according to claim 1.

* * * * *